US009304483B2

(12) United States Patent
Komatsu et al.

(10) Patent No.: US 9,304,483 B2
(45) Date of Patent: Apr. 5, 2016

(54) CARTRIDGE, IMAGE FORMING APPARATUS AND MAIN ASSEMBLY OF IMAGE FORMING APPARATUS

(71) Applicant: CANON KABUSHIKI KAISHA, Tokyo (JP)

(72) Inventors: Noriyuki Komatsu, Numazu (JP); Yuuki Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/320,730

(22) Filed: Jul. 1, 2014

(65) Prior Publication Data

US 2015/0010320 A1 Jan. 8, 2015

(30) Foreign Application Priority Data

Jul. 3, 2013 (JP) ..... 2013-139633

(51) Int. Cl.
*G03G 15/00* (2006.01)
*G03G 21/16* (2006.01)
*G03G 21/18* (2006.01)

(52) U.S. Cl.
CPC ..... *G03G 21/1652* (2013.01); *G03G 21/1842* (2013.01); *G03G 21/1867* (2013.01); *G03G 21/1875* (2013.01); *G03G 21/1896* (2013.01); *G03G 21/1853* (2013.01)

(58) Field of Classification Search
CPC ..... G03G 21/1652; G03G 21/1867; G03G 21/1875; G03G 21/1885
USPC ..... 399/12, 90, 111, 113, 119
See application file for complete search history.

(56) References Cited

U.S. PATENT DOCUMENTS

| | | | | |
|---|---|---|---|---|
| 6,671,477 | B2 | 12/2003 | Komatsu et al. | |
| 6,898,392 | B2 * | 5/2005 | Karakama et al. | 399/90 |
| 7,024,131 | B2 | 4/2006 | Komatsu et al. | |
| 7,110,703 | B2 | 9/2006 | Uratani et al. | |
| 7,156,797 | B2 | 1/2007 | Komatsu et al. | |
| 7,184,682 | B2 * | 2/2007 | Chadani et al. | 399/90 |
| 7,194,220 | B2 * | 3/2007 | Sasaki et al. | 399/90 |
| 7,266,326 | B2 | 9/2007 | Karakama et al. | |
| 7,283,765 | B2 | 10/2007 | Uratani et al. | |
| 7,953,346 | B2 * | 5/2011 | Ahn et al. | 399/111 |
| 8,036,543 | B2 | 10/2011 | Yokomori et al. | |

(Continued)

FOREIGN PATENT DOCUMENTS

| | | |
|---|---|---|
| JP | 2004045857 | 2/2004 |
| JP | 2006-119467 A | 5/2006 |

*Primary Examiner* — William J Royer
(74) *Attorney, Agent, or Firm* — Fitzpatrick, Cella, Harper & Scinto

(57) ABSTRACT

A cartridge includes a receiving recessed portion, a contact portion and a main assembly electrical contact. In a state in which the cartridge is mounted at an image forming position of the main assembly, the cartridge includes a first positioning projection held in the receiving recessed portion; a second positioning projection, provided at a position different from a position of the first positioning projection, contacting the contact portion; and an information storing member including a storing element for storing information and a storing element contact electrically connected with the storing element, wherein the storing element contact contacts the main assembly electrical contact. Moment, about the first positioning projection, applied to the cartridge by a force applied from the main assembly electrical contact to the storing element contact acts in a direction of urging the second positioning projection to the contact portion.

16 Claims, 19 Drawing Sheets

(56) References Cited

U.S. PATENT DOCUMENTS

| | | | |
|---|---|---|---|
| 8,180,251 | B2 | 5/2012 | Nakamura et al. |
| 8,275,283 | B2 | 9/2012 | Uneme et al. |
| 8,326,178 | B2 | 12/2012 | Nakamura et al. |
| 8,401,441 | B2 | 3/2013 | Uneme et al. |
| 8,571,445 | B2 | 10/2013 | Komatsu et al. |
| 8,687,994 | B2 | 4/2014 | Nakamura et al. |
| 8,787,794 | B2 | 7/2014 | Miyazaki et al. |
| 2003/0215257 | A1 | 11/2003 | Karakama et al. |
| 2012/0183328 | A1 | 7/2012 | Nakamura et al. |
| 2012/0243905 | A1 | 9/2012 | Uratani et al. |
| 2014/0064776 | A1 | 3/2014 | Yamasaki et al. |
| 2014/0112685 | A1 | 4/2014 | Komatsu et al. |
| 2014/0212181 | A1 | 7/2014 | Nakamura et al. |
| 2014/0270845 | A1 | 9/2014 | Kawakami et al. |

* cited by examiner

CARTRIDGE, IMAGE FORMING APPARATUS AND MAIN ASSEMBLY OF IMAGE FORMING APPARATUS

FIELD OF THE INVENTION AND RELATED ART

The present invention relates to a cartridge detachably (removably) mountable to an apparatus main assembly of an image forming apparatus for forming an image on a recording material (medium). Further, the present invention relates to the image forming apparatus, to which the cartridge is detachably mountable, for forming the image on the recording material. Further, the present invention relates to the apparatus main assembly of the image forming apparatus.

Here, the image forming apparatus is an apparatus for forming the image on the recording material by using an image forming process of each of known various image forming principles or types, such as an electrophotographic process, an electrostatic recording process and a magnetic recording process. Examples of the image forming apparatus may include a copying machine, a printer (LED printer, laser printer or the like), a facsimile apparatus, a word processor, and an image display apparatus (electronic blackboard or electronic white board).

The recording material is a material on which the image is to be formed, and includes, e.g., paper, an OHP sheet and the like. The recording material also includes an intermediary transfer medium or an image display member for the image display apparatus or the like.

As the cartridge, e.g., there is a developing cartridge including a developer carrying member for carrying a developer. Further, there is also a process cartridge prepared by integrally assembling a part or all of an image forming portion including an image bearing member on which a developer image is to be formed and an image forming process means actable on the image bearing member, into a unit. Further, the process cartridge is detachably mounted into the apparatus main assembly of the image forming apparatus and contributes to the image forming process for forming the image on the recording material. The apparatus main assembly is an image forming apparatus constituent portion excluding the cartridge in the image forming apparatus of a cartridge type.

Examples of the image bearing member may include an electrophotographic photosensitive member in the electrophotographic process, an electrostatic recording dielectric member in the electrostatic recording process, a magnetic recording (magnetic) material in the magnetic recording process, and members capable of forming images by other various image forming principles or types. The image forming process means is an image forming process means or device for forming the image by acting on the image bearing member.

In the following, for convenience, description will be made by taking the electrophotographic image forming as an example. The process cartridge is prepared by integrally assembling the electrophotographic photosensitive member and the process means actable on the electrophotographic photosensitive member into a unit, and is detachably mountable to the apparatus main assembly of the electrophotographic image forming apparatus. For example, the electrophotographic photosensitive member and, as the process means, at least one of a charging means, a developing means or a cleaning means are integrally assembled into a cartridge or a unit.

Accordingly, the process cartridge also includes a cartridge which is prepared by integrally assembling the electrophotographic photosensitive member and the developing means as the process means into a unit and which is detachably mountable to the apparatus main assembly. The process cartridge further includes a cartridge which is prepared by integrally assembling the electrophotographic photosensitive member and, as the process cartridge, the charging means, the developing means or the cleaning means into a unit and which is detachably mountable to the apparatus main assembly.

The process cartridge which includes the electrophotographic photosensitive member and the developing means as a unit is referred to as the process cartridge of a so-called integral type. Further, the process cartridge which includes the electrophotographic photosensitive member and the process means other than the developing means as a unit is referred to as the process cartridge of a so-called separation type. That is, the type in which the developing means is provided a developing unit separately from the process cartridge and the process cartridge forms the image by being paired with the developing unit is referred to as the so-called separation type. The cartridge can be mounted to and demounted from the apparatus main assembly by an operator himself (herself). For that reason, maintenance of the apparatus main assembly can be easily carried out.

Further, the developing cartridge includes a developing roller (developer carrying member for supplying the developer to the electrophotographic photosensitive member). Further, the developing cartridge accommodates the developer (toner) used for developing an electrostatic latent image formed on the electrophotographic photosensitive member, and is detachably mountable to the apparatus main assembly.

In the case of the developing cartridge, the electrophotographic photosensitive member is mounted to the apparatus main assembly or a cartridge supporting member. Alternatively, the electrophotographic photosensitive member is provided in the above-described process cartridge of the so-called separation type. In this case, the process cartridge does not include the developing means. Also the developing cartridge can be mounted to and demounted from the apparatus main assembly by the operator himself(herself). For that reason, it is possible to easily carry out the maintenance of the apparatus main assembly.

Therefore, the cartridge includes the process cartridge of the so-called integral type or the so-called separation type. The cartridge also includes the case where the process cartridge of the so-called separation type and the developing cartridge are used in a pair. Further, the cartridge includes the case where the electrophotographic photosensitive member is fixedly mounted to the apparatus main assembly or the cartridge supporting member and the developing cartridge is detachably used so as to be actable on the electrophotographic photosensitive member. The cartridge further includes an image forming function unit, detachably mountable to the apparatus main assembly, contributing to the image forming process for forming the image on the recording material.

As the above-described cartridges, in recent years, products in which a storing element (memory) for storing service information or process information is mounted have been realized. The image forming apparatus further improves an image quality and a cartridge maintenance property by using the storing element information of the cartridge. The image forming apparatus establishes electrical communication by making electrical connection between a main assembly electrical contact of a connector provided in the apparatus main assembly and a storing element contact (electrical contact) connected with the storing element of the cartridge.

As a constitution for stably performing contact between the storing element contact of the cartridge and the main assembly electrical contact provided in the apparatus main assembly, a constitution in which a back-up member for urging the cartridge in a direction opposite to a connector urging direction from the apparatus main assembly has been devised (Japanese Laid-Open Patent Application (JP-A) 2004-45857).

SUMMARY OF THE INVENTION

The present invention is a further development of the above-described conventional constitution. A principal object of the present invention is to stabilize contact between a storing element contact connected with a storing element (memory) of a cartridge and a main assembly electrical contact of a connector provided in an apparatus main assembly.

According to an aspect of the present invention, there is provided a cartridge detachably mountable to a main assembly of an image forming apparatus, including a receiving recessed portion, a contact portion and a main assembly electrical contact, for forming an image on a recording material, wherein the cartridge contributes to an image forming process for forming the image on the recording material, the cartridge comprising: in a state in which the cartridge is mounted at an image forming position of the main assembly, a first positioning projection held in the receiving recessed portion; a second positioning projection, provided at a position different from a position of the first positioning projection, contacting the contact portion; and an information storing member including a storing element for storing information and a storing element contact electrically connected with the storing element, wherein the storing element contact contacts the main assembly electrical contact, wherein moment, about the first positioning projection, applied to the cartridge by a force applied from the main assembly electrical contact to the storing element contact acts in a direction of urging the second positioning projection to the contact portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described with reference to the drawings. Although the following embodiments are examples to which the present invention is applicable, the present invention is not limited to the embodiments but can also be modified within the scope of a concept of the present invention. The scope of the present invention is not intended to be limited to functions, materials, shapes, relative arrangement and the like of constituent elements in the following embodiment unless otherwise specified.

Embodiment 1

General Structure of Image Forming Apparatus

Figure 2:
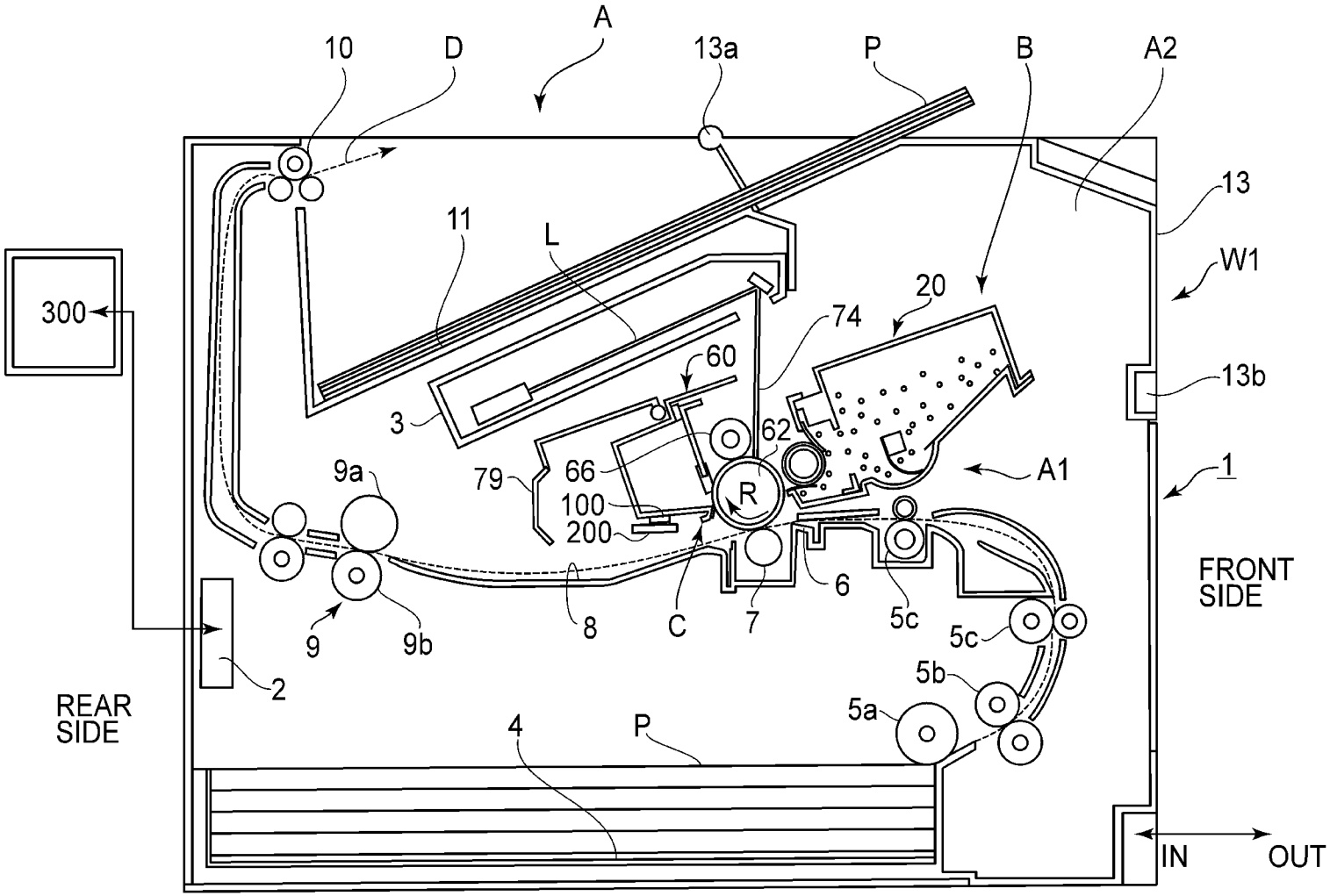
FIG. 2 is a sectional view of an apparatus main assembly of an image forming apparatus and a process cartridge.

FIG. 2 is a schematic longitudinal left side view of an image forming apparatus 1 in Embodiment 1. This image forming apparatus 1 is a laser printer (electrophotographic image forming apparatus) of a cartridge type using an electrophotographic process. The image forming apparatus 1 is capable of forming an image on a sheet-shaped recording material (sheet) as a recording medium on the basis of an electrical image (picture) signal inputted from a host device 300 such as a personal computer into a control circuit portion 2.

Here, with respect to the image forming apparatus 1, a front side refers to a side where an openable door 13 is provided. A rear side refers to a side opposite from the front side. Left and right refer to those as seen from the front side. Upper (up) and lower (low) refer to those with respect to a direction of gravitation. A front-rear direction includes a (forward) direction directed from the rear side toward the front side and a (backward) direction directed from the front side toward the rear side. A left-right direction include a (leftward) direction directed from the right side toward the left side and a (rightward) direction directed from the left side toward the right side. With respect to the image forming apparatus 1 in this embodiment, the right side is a driving side, and the left side is a non-driving side.

Inside an apparatus main assembly A of the image forming apparatus 1, at a central portion, a cartridge mounting portion (cartridge accommodating portion) A1 is provided. To this cartridge mounting portion A1, a cartridge B (a process cartridge of an integral type in this embodiment) described later is positioned at a predetermined mounting position (image forming position) C and is detachably mounted. Above the process cartridge B, mounted at the mounting position, an exposure device 3 (laser scanner unit) is provided.

Further, below the cartridge B, a sheet (feeding) tray 4 in which a sheet material P is accommodated is provided. Further, in the apparatus main assembly A, along a conveyance direction D of the sheet material P, a pick-up roller 5*a*, a feeding roller pair 5*b*, a conveying roller pair 5*c*, a transfer guide 6, a transfer roller 7, a conveying guide 8, a fixing device 9, a discharging roller pair 10 and the like are successively provided. These members are a feeding (conveying) means for feeding (conveying) the sheet P. In an upper surface side of the apparatus main assembly A, a discharge tray 11 is provided. The fixing device 9 is constituted by a heating roller 9*a* and a pressing roller 9*b*. The sheet tray 4 is capable of going into and coming out from the apparatus main assembly A from the front side of the image forming apparatus 1 (front loading).

A drum-type electrophotographic photosensitive member (drum) 62 as a rotatable image bearing member in the cartridge B mounted at the mounting position is rotationally driven at a predetermined peripheral speed (process speed) in an arrow R direction which is the clockwise direction. Further, a charging roller 66 to which a bias voltage is applied contacts the outer peripheral surface of the photosensitive drum 62 and electrically charges the outer peripheral surface of the photosensitive drum 62 uniformly to a predetermined polarity and a predetermined potential.

The exposure device 3 outputs laser light L modulated depending on image information. The laser light L passes through an exposure window portion 74 provided at an upper surface of the cartridge B and enters the cartridge B, so that the charged outer peripheral surface of the drum 62 is subjected to scanning exposure. As a result, on the outer peripheral surface of the drum 62, an electrostatic latent image depending on the image information is formed.

Figure 3:
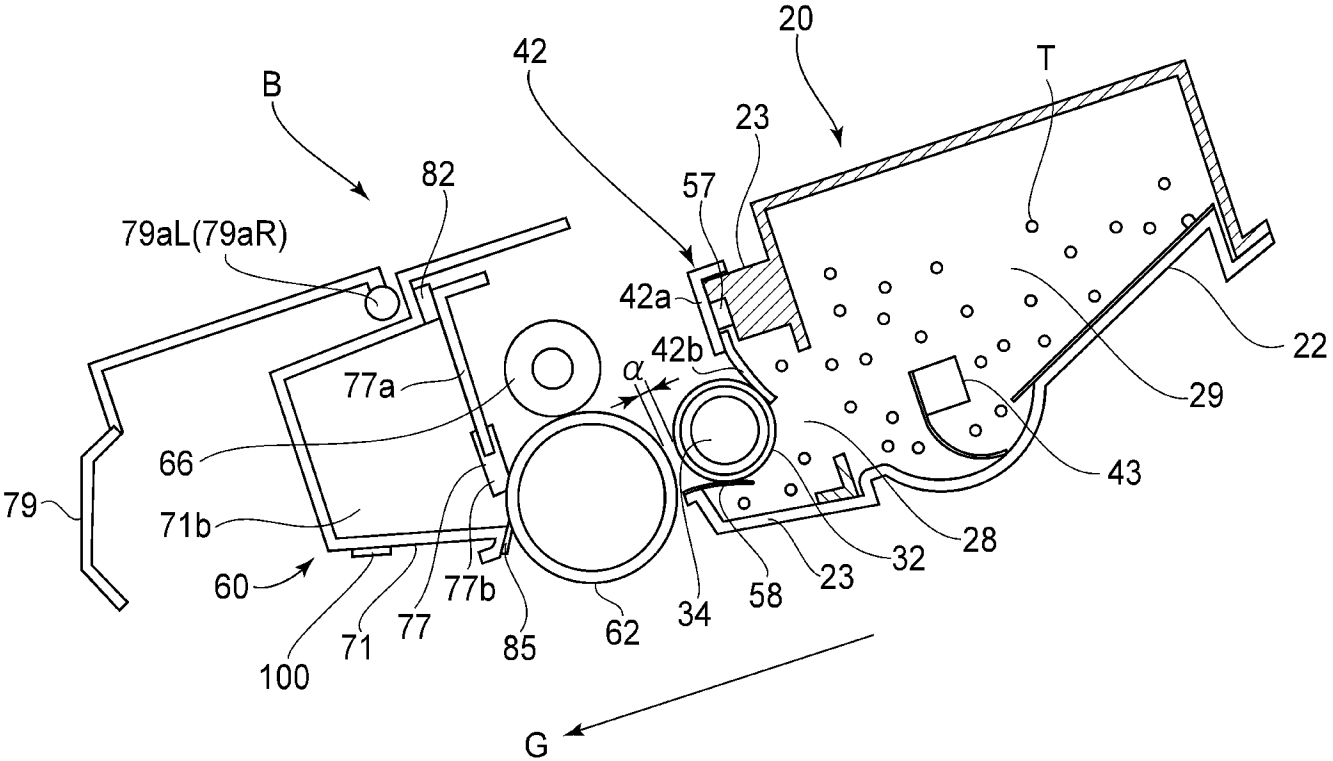
FIG. 3 is an enlarged sectional view of the process cartridge.

On the other hand, as shown in FIG. 3, in a developing device unit 20 as a developing device, a toner (developer) T in a toner chamber (developer accommodating portion) 29 is stirred and fed by rotation of a feeding member 43, so that the toner T is sent to a toner supplying chamber 28.

The toner T is carried by a magnetic force of a magnet roller 34 (fixed magnet) on a surface of a developing roller (developer carrying member) 32. The toner T is regulated in layer thickness by a developing blade 42 while being triboelectrically charged. The toner T is transferred onto the drum 62 depending on the electrostatic latent image, so that the electrostatic latent image is visualized as a toner image.

Further, in synchronism with output timing of the laser light L, by the pick-up roller 5*a*, the feeding roller pair 5*b* and the conveying roller pair 5*c*, the sheet material P accommodated at a lower portion of the apparatus main assembly A is fed and conveyed from the sheet tray 4. Then, the sheet material P is conveyed to a transfer position between the drum 62 and the transfer roller 7 via the transfer guide 6. In this transfer position, the toner image is successively transferred from the drum 62 onto the sheet material P. The sheet material P on which the toner image is transferred is separated from the drum 62 and then is conveyed to the fixing device 9 along the conveying guide 8.

Then, the sheet material P passes through a fixing nip between the heating roller 9*a* and the pressing roller 9*b* which constitute the fixing device 9. At this fixing nip, pressure and heat fixing is effected, so that the toner image is fixed on the sheet material P. The sheet material P on which the toner image is fixed is conveyed to the discharging roller pair 10 and then is discharged onto the discharge tray 11. On the other hand, as shown in FIG. 2, the drum 62 after the transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60.

[General Structure of Cartridge]

Next, with respect to FIGS. 3 and 4, a general structure of the cartridge B will be described. This cartridge B is the process cartridge of the integral type in which the drum (image bearing member) 62 and, as a process means actable on the drum 62 the charging roller (charging means) 66, the developing roller (developing means) 32 and the cleaning blade (cleaning means) 77 are provided. The cartridge B is an assembly extending in a left-right direction (longitudinal direction) which is a rotational axis direction of the drum 62. With respect to the longitudinal direction of the cartridge B, one side where a driving force from the apparatus main assembly A is received by the drum 62 is the driving side (a driving force receiving portion 63*a* side in FIGS. 1, 4 and 5), and an opposite side (the other side) is the non-driving side.

Figure 4:
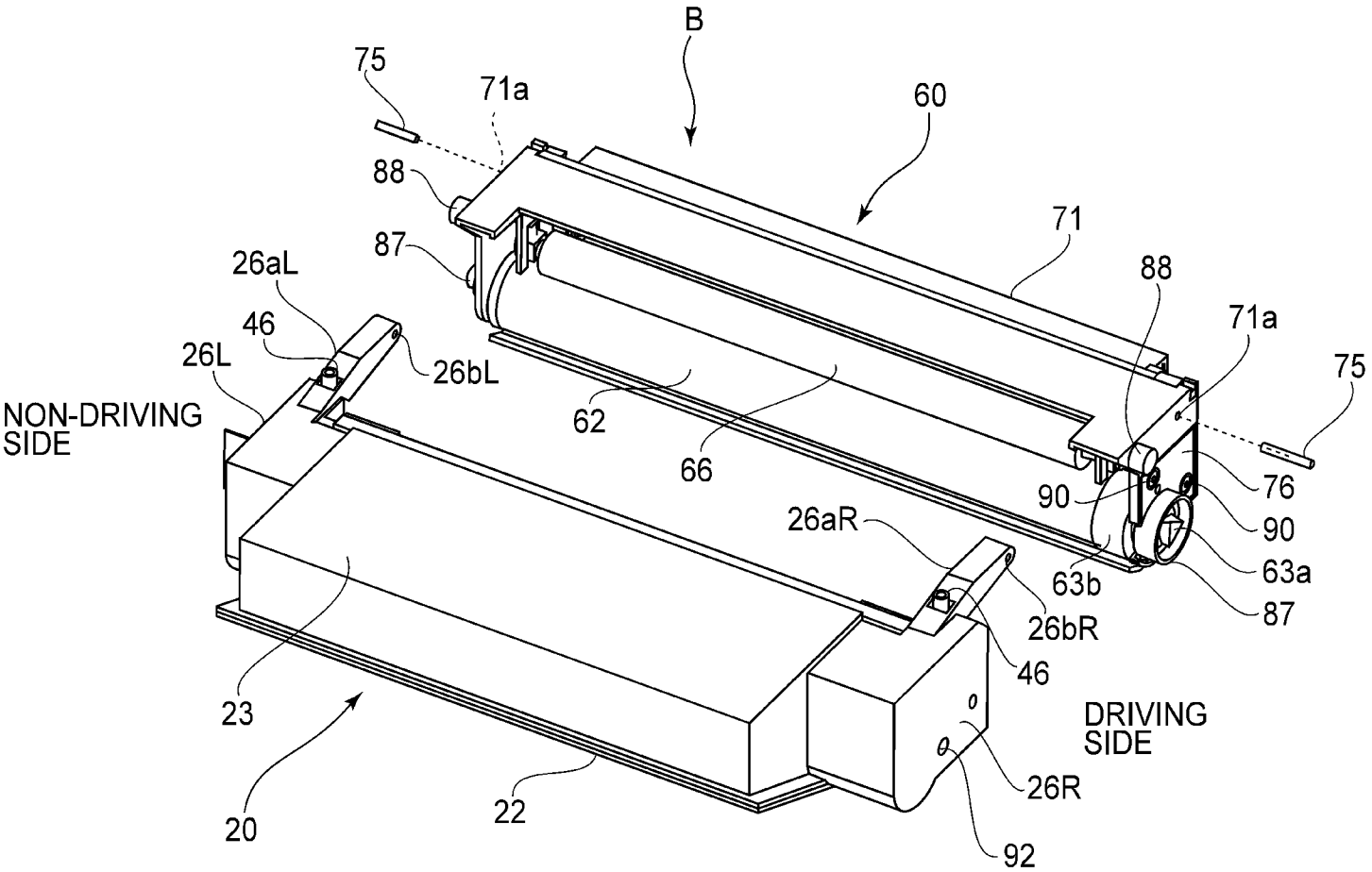
FIG. 4 is an exploded perspective view for illustrating a structure of the process cartridge.

FIG. 4 is an exploded perspective view for illustrating a structure of the cartridge B. The cartridge B is constituted by combining the cleaning (device) unit 60 and the developing device unit 20. The cleaning unit 60 is constituted by a cleaning frame 71, the drum 62, the charging roller 66, the cleaning blade 77 and the like.

The developing device unit 20 is constituted by a bottom member 22, a developing container 23, first and second side members 26L and 26R, the developing blade 42, the developing roller 32, the magnet roller 34, the feeding member 43, the toner T, an urging member 46, and the like.

The cleaning unit 60 and developing device unit 20 are rotationally movably connected with each other by a connecting member 75, so that the cartridge B is constituted.

Specifically, at free end portions of arm portions 26*a*L and 26*a*R formed on the first and second side members 26L and 26R, respectively, provided at end portions of the developing device unit 20 with respect to a longitudinal direction of the developing device unit 20 (a rotational axis direction of the developing roller 32), rotational movement holes 26*b*L and 26*b*R are provided. The rotational movement holes 26*b*L and 26*b*R are provided in parallel with the developing roller 32. Further, at each of longitudinal end portions of the cleaning frame 71, an engaging hole 71*a* for permitting engagement therein of the connecting member 75 is formed.

Then, the arm portions 26*a*L and 26*a*R are aligned with predetermined positions of the cleaning frame 71, and then the connecting members 75 are inserted into the rotational movement holes 26*b*L and 26*b*R and the engaging holes 71*a*. As a result, the cleaning unit 60 and the developing device unit 20 are connected with each other rotatably about the connecting members 75.

At this time, urging members 46 mounted at base portions of the arm portions 26*a*L and 26*a*R abut against the cleaning frame 71, so that the urging members 46 urge the developing device unit 20 toward the cleaning unit 60 with the connecting members 75 as the rotation centers. As a result, the developing roller 32 is pressed toward the drum 62 with reliability. Then, by a gap (spacing) holding member (FIG. 6) mounted at each of the end portions of the developing roller 32, the developing roller 32 is held with a predetermined gap $\alpha$ (FIG. 3) from the photosensitive drum 62.

[Structure of Cleaning Unit]

Figure 5:
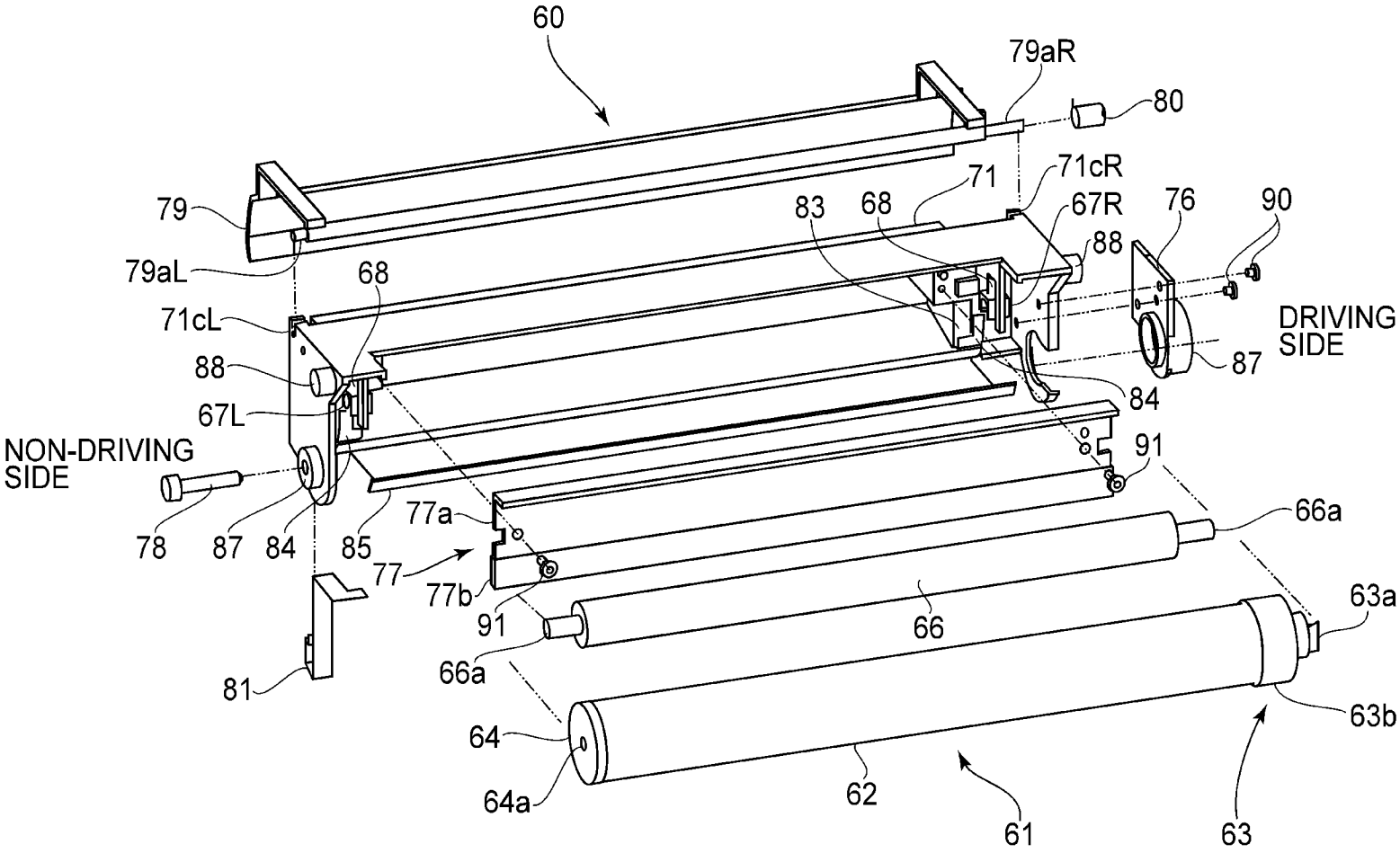
FIG. 5 is an exploded perspective view for illustrating a structure of a cleaning unit.

FIG. 5 is an exploded perspective view for illustrating the structure of the cleaning unit 60. The cleaning blade 77 is constituted by a supporting member 77*a* formed with a metal plate and an elastic member 77*b* formed of an elastic material such as urethane rubber, and is fixed on the cleaning frame 71 by screws 91 at longitudinal end portions of the supporting member 77*a*, thus being provided in a predetermined position. The elastic member 77*b* contacts the drum 62, so that the residual toner is removed from the outer peripheral surface of the drum 62. The removed toner is stored in the residual toner chamber 71*b* (FIG. 3).

A first seal member 82 (FIG. 3), a second seal member 83, a third seal member 84 and a fourth seal member 85 are fixed to the cleaning frame 71 at predetermined positions by a double-side tape or the like.

The first seal member 82 is provided over the longitudinal direction and prevents the leakage-out of the residual toner from a back side of the supporting member 77*a* of the cleaning blade 77. The second seal member 83 prevents the leakage-out of the residual toner from longitudinal ends of an elastic member 77*b* of the cleaning blade 77. The third seal member 84 wipes off a deposited matter such as the toner from the drum 62 while preventing the leakage-out of the residual toner from the longitudinal ends of the elastic member 77*b* of the cleaning blade 77. The fourth seal member 85 is provided in contact with the drum 62 over the longitudinal direction and prevents the leakage-out of the residual toner from an upstream side of the cleaning blade 77 with respect to the rotational direction of the drum 62.

An electrode plate 81, an urging member 68 and charging roller bearings 67L and 67R are mounted on the cleaning frame 71. A shaft portion 66*a* of the charging roller 66 is engaged into the charging roller bearings 67L and 67R. The charging roller 66 is urged toward the drum 62 by the urging member 68, and is rotatably supported by the charging roller bearings 67L and 67R. Then, the charging roller 66 is rotated by rotation of the drum 62.

The electrode plate 81, the urging member 68, the charging roller bearing 67L and the shaft portion 66*a* have electroconductivity. In a state in which the cartridge B is mounted at the mounting position, the electrode plate 81 contacts an electric power supplying portion (not shown) in the apparatus main assembly A side. The electric power supplying portion supplies electric power to the charging roller 66 along an electric power supplying path constituted by the above members.

The drum 62 is connected integrally with flanges 63 and 64 and thus is constituted as an electrophotographic photosensitive drum unit 61. This connecting method uses caulking, bonding, welding or the like. To the flange 64, an unshown grounding contact and the like are connected. Further, the flange 63 includes the driving force receiving portion 63*a* for receiving a driving force from the apparatus main assembly A and includes a flange gear portion 63*b* for transmitting the driving force to the developing roller 32.

A bearing member 76 is integrally fixed to a side plate of the cleaning frame 71 with screws 90 in the driving side, and a drum shaft 78 is press-fitted and fixed in a side plate of the cleaning frame 71 in the non-driving side. Further, the bearing member 76 is engaged with the flange 63, and a drum shaft 78 is engaged with a hole 64*a* of the flange 64.

As a result, the drum unit 61 is rotatably supported by the cleaning frame 71. A protective member 79 is rotatably supported by the cleaning frame 71 so as to permit protection (light blocking) and exposure of the drum 62. An urging member 80 is mounted on a driving side shaft portion 79*a*R of the protective member 79 and urges the protective member 79 in a direction of protecting the drum 62. A non-driving side shaft portion 79*a*L and the driving side shaft portion 79*a*R of the protective member 79 are engaged with bearing portions 71*c*L and 71*c*R of the cleaning frame 71.

Figure 1:
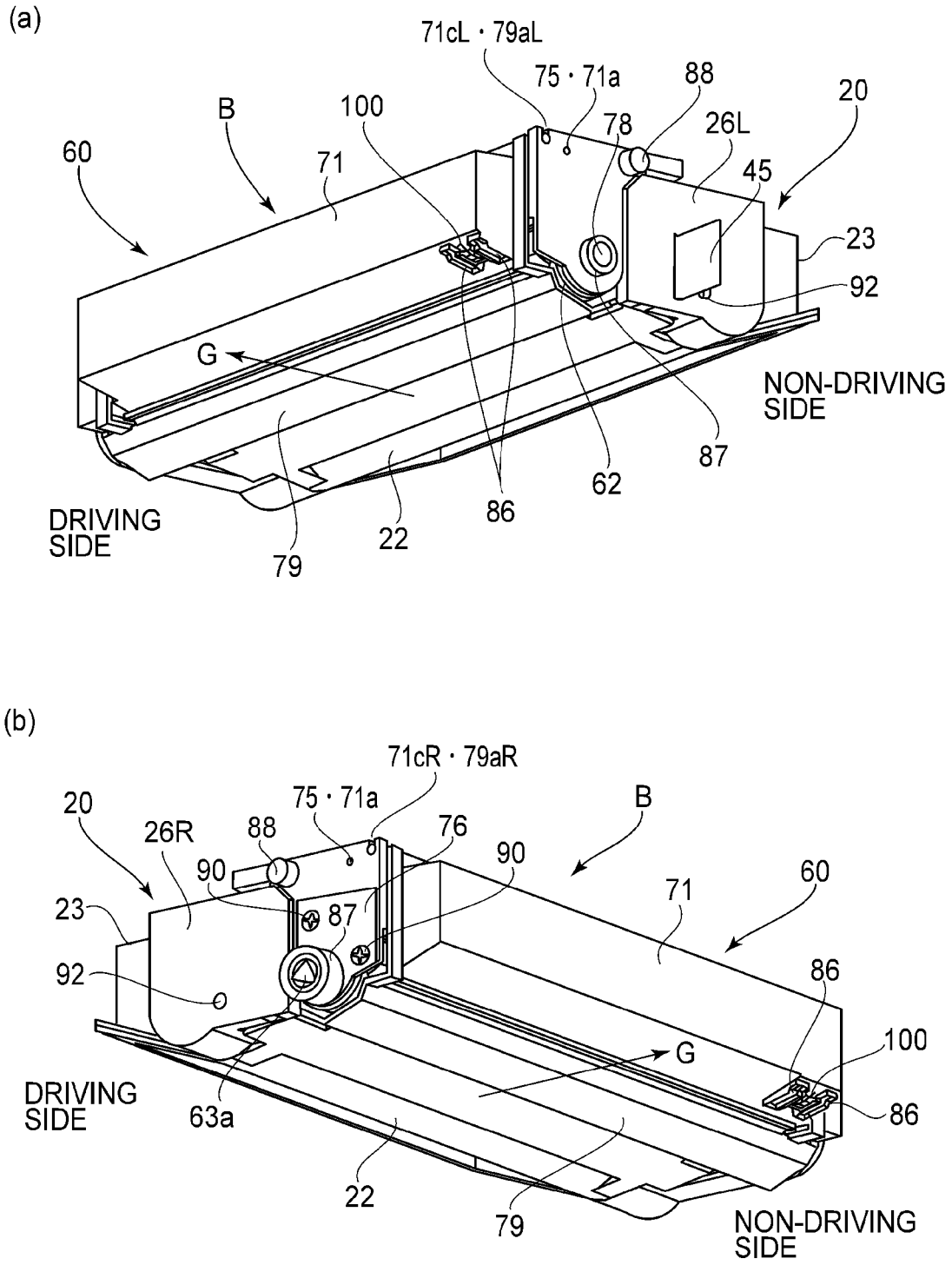
In FIG. 1, (*a*) and (*b*) are perspective views of a process cartridge in Embodiment 1.

In a state in which the cartridge B is demounted from the apparatus main assembly A, the protective member 79 is rotated about the shaft portions 79*a*L and 79*a*R in a closing direction toward a lower side of the cartridge B as shown in FIG. 1 by an urging force of the urging member 80. As a result, the lower surface of the drum 62 is shielded and protected.

Further, in a state in which the cartridge B is mounted at the mounting position C, the protective member 79 is rotated about the shaft portions 79*a*L and 79*a*R in an opening direction toward the front side of an inserting direction of the cartridge B as shown in FIGS. 2 and 3 against the urging force of the urging member 80. As a result, the drum 62 is opened at the lower surface, so that the drum 62 is placed in a predetermined contact state with the transfer roller 7.

In an insertion movement process of the cartridge B toward the cartridge mounting portion A1, the protective member 79 operates from the closing state to the opening state by engagement with an engaging member (not shown) in the apparatus main assembly A side. Further, in a pulling-out movement process of the cartridge B from the cartridge mounting portion A1, the protective member 79 operates from the opening state to the closing state by the engagement with the engaging member in the apparatus main assembly A side.

Further, outer surfaces of the side plates of the cleaning frame 71 in the non-driving side and the driving side, a first positioning projection (positioning boss) 87 and a second positioning projection (positioning boss) 88 are provided, respectively, in a bilaterally symmetrical manner.

In this embodiment, the first positioning projection 87 in the non-driving side is a cylindrical boss portion provided coaxially with a hole portion, of the side plate in the non-driving side, into which the drum shaft 78 is press-fitted and fixed. The first positioning projection 87 in the driving side is the cylindrical boss portion provided coaxially with the bearing portion of the bearing member 76 fixed integrally with the side plate in the driving side by screws 90. Inside this first positioning projection 87, the developing roller driving force receiving portion 63*a* of the drum unit 61 is positioned. Accordingly, in this embodiment, the first positioning projections 87 in the non-driving side and the driving side are members provided coaxially with the rotational axis of the drum 62.

Further, each of the second positioning projections 88 in the non-driving side and the driving side is a cylindrical boss portion provided upstream of the first positioning projection 87 with respect to an insertion direction G of the cartridge B and provided at a position upwards of the first positioning projection 87. Further, as described later, an information storing member 100 including a storing element is provided at the lower surface of the cleaning frame 71 in the non-driving side and provided downstream of the first positioning projection 87 with respect to the insertion direction G of the cartridge B (FIG. 1).

[Developing Device Unit]

Figure 6:
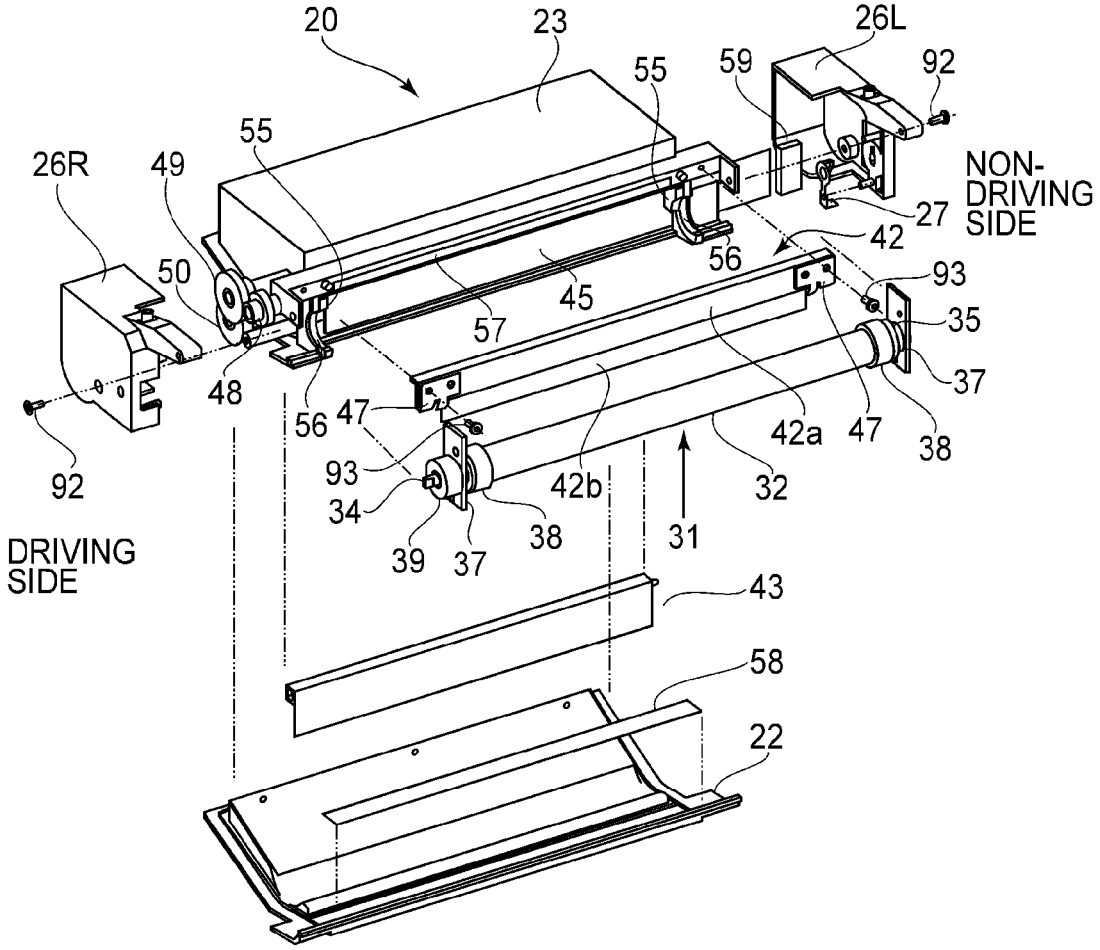
FIG. 6 is an exploded perspective view for illustrating a structure of a developing unit.

FIG. 6 is an exploded perspective view for illustrating the structure of the developing device unit 20. A developing (device) frame consisting of the developing container 23 and the bottom member 22 defines the toner chamber 29 in which the toner T is accommodated, and the toner supplying chamber 28 (FIG. 3). The developing container 23 and the bottom member 22 are integrally connected with each other by welding or the like.

The feeding member 43 is supported by the developing container 23 in the non-driving side, and is fixed to a feeding gear 50 mounted in the developing container 23 in the driving side. As a result, the feeding member 43 is rotated in the toner chamber 29 by the rotation of the feeding gear 50.

A toner seal member 45 is (thermally) welded with the developing container 23 and partitions the toner chamber 29 and the toner supplying chamber 28. As a result, the toner seal member 45 prevents the leakage-out of the toner T from the toner supplying chamber 28 during transportation of the cartridge B. An operator removes the toner seal member 45, whereby the toner T is fed into the toner supplying chamber 28.

A first seal member 55, a second seal member 56 and a third seal member 57 are fixed to the developing container 23 at predetermined positions by the double-side tape or the like. A fourth seal member 58 is fixed to the bottom member 22 at a predetermined position by the double-side tape or the like after the developing container 23 and the bottom member 22 are connected with each other. Further, a fifth seal member 59 is provided on the developing container 23. The first seal member 55 prevents the leakage-out of the toner T from longitudinal ends of an elastic member 42*b* of the developing blade 42. The second seal member 56 prevents the leakage-out of the toner T from longitudinal ends of the developing roller 32.

The third seal member 57 is provided over the longitudinal direction and prevents the leakage-out of the toner T from a back side of a supporting member 42*a* of the developing blade 42. The fourth seal member 58 is provided in contact with the developing roller 32 over the longitudinal direction and prevents the leakage-out of the toner T from the lower side of the developing roller 32. The fifth seal member 59 prevents, when the toner seal member 45 is removed and taken out from a removal opening (not shown) to an outside of the developing device unit 20, the leakage-out of the toner T in intimate contact with the removal opening simultaneously with wiping of the toner T deposited on the surface of the toner seal member 45.

The developing blade 42 is constituted by the supporting member 42*a* formed with a metal plate and the elastic member 42*b* formed of an elastic material such as an urethane rubber, and is fixed together with a cleaning member 47 in a predetermined position relative to the developing container 23 by screws 93 at end portions of the supporting member 42*a*. The elastic member 42*b* contacts the developing roller 32, thus defining a toner amount at the peripheral surface of the developing roller 32 and at the same time, imparting triboelectric charges to the toner T.

The cleaning member 47 removes the deposited matter such as the toner T by contact with an end portion surface of the developing roller 32. A developing roller unit 31 is constituted by the developing roller 32, the magnet roller 34, a flange 35, the gap holding member 38, a bearing member 37, a developing roller gear 39 and the like.

From an end portion of the developing roller 32 in the non-driving side, the magnet roller 34 is inserted, and at the end portion, the flange 35 is press-fitted and fixed. With the flange 35, an electroconductive electrode wire (not shown) is assembled, and contacts the developing roller 32 and an electrode plate 27. The electroconductive electrode plate 27 is fixed to the first side member 26L. In the state in which the cartridge B is mounted at the mounting position C, the electrode plate 27 contacts the electric power supplying portion (not shown) provided in the apparatus main assembly A, and supplies the electric power to the developing roller 32 through the electrode wire as an electric power supplying path.

The gap holding member 38 is mounted at each of the end portions of the developing roller 32. Further, outside the gap holding member 38, the bearing member 37 is disposed, and in the driving side, the developing roller gear 39 is assembled outside the bearing member 37. By the bearing member 37 being disposed at each of the end portions of the developing roller 32, the developing roller 32 is rotatably supported.

First and second gears 48 and 49 as a drive transmission member are rotatably engaged with the developing frame.

The first and second side members 26L and 26R are fixed with screws 92 at end portions, respectively, of the developing frame with respect to the longitudinal direction of the developing frame. At that time, the bearing members 37 of the developing roller unit 31 are held by the first and second side members 26L and 26R.

Figure 10:
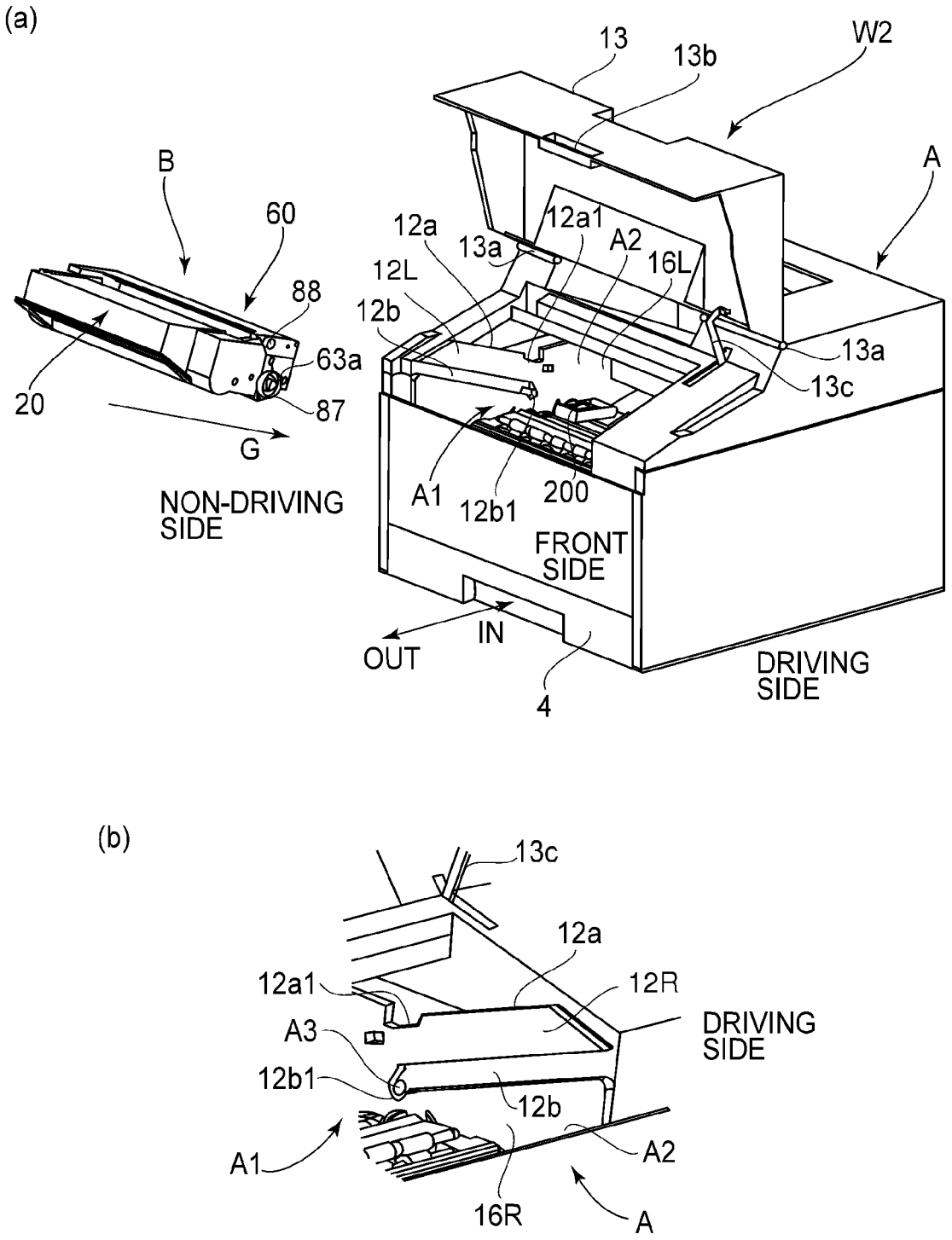
In FIG. 10, (*a*) and (*b*) are perspective views for illustrating a mounting and demounting structure of the process cartridge.

In the state in which the cartridge B is mounted at the mounting position C, the developing roller force is transmitted from a driving force outputting portion A3 ((b) of FIG. 10) in the apparatus main assembly A side to the driving force receiving portion 63*a* in the cleaning unit 60 side. As a result, the drum 62 of the drum unit 61 and the flange gear portion 63*b* (FIG. 5) are rotationally driven. Then, the flange gear portion 63*b* (FIG. 5), the developing roller gear 39, the first gear 48, the second gear 49 and the feeding gear 50 are successively engaged with each other and then are rotated, so that the driving force received by the driving force receiving portion 63*a* is transmitted to the developing roller 32 and the feeding member 43 of the developing device unit 20.

(Information Storing Member)

Figure 7:
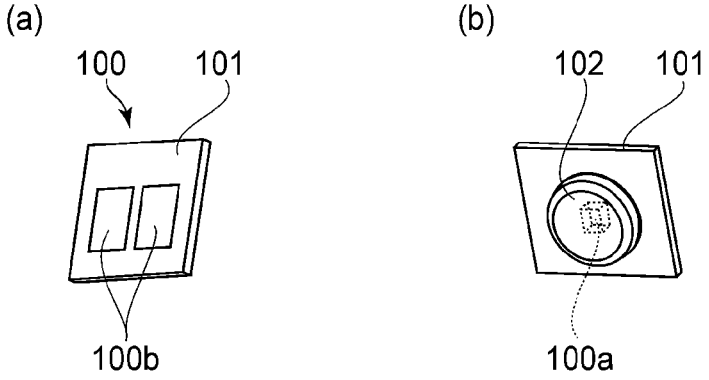
In FIG. 7, (*a*) and (*b*) are schematic views each showing another appearance of an information storing member.

The cartridge B is provided with the information storing member 100 (memory tag). In this embodiment, as shown in FIG. 1, the memory tag 100 and connector positioning holes 86 (FIG. 8) are provided at the lower surface in the non-driving side. The memory tag 100 is provided with a storing element 100*a* (memory indicated by a dotted line) for storing information in one side of a substrate 101 as shown in (a) of FIG. 7, and is protected by a resinous coating layer 102. In the other surface side of the substrate 101, as shown in (a) of FIG. 7, storing element (electrical) contacts 100*b* (memory contacts) which are electrically connected with the memory 100*a* are provided.

In the state in which the cartridge B is mounted at the mounting position C, the memory contacts 100*b* provided in the cartridge B side and main assembly electrical contacts 201 (FIG. 11), described later, provided in the apparatus main assembly A side contact each other. Then, communication (information transfer) between the memory 100*a* and the control circuit portion 2 of the apparatus main assembly A is established.

Figure 8:
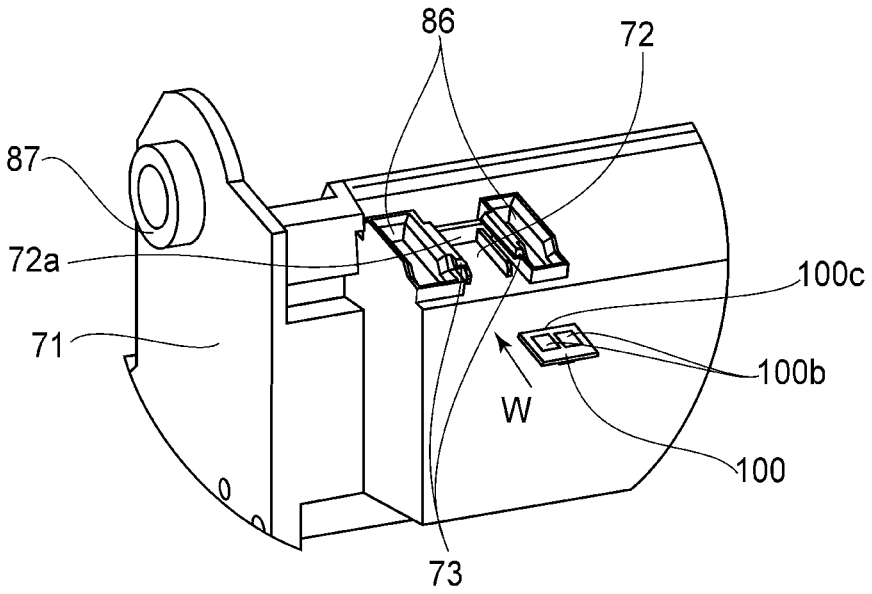
FIGS. 8 and 9 are perspective views for illustrating a mounted structure of the information storing member.

A mounting method of the memory tag 100 to the cartridge B will be described. As shown in FIG. 8, the memory tag 100 is inserted, with the memory contacts 100*b* side outward, from a direction indicated by an arrow W in FIG. 8 into a slit portion 72 provided on the cleaning frame 71.

Figure 9:
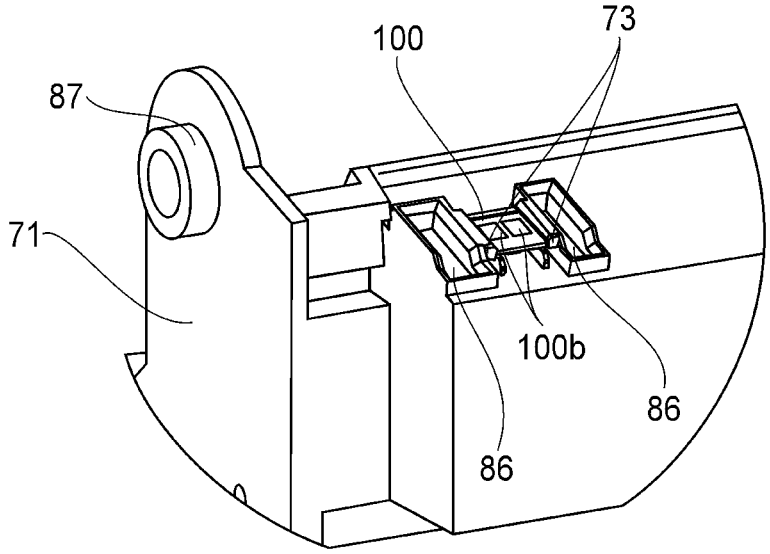

The memory tag 100 engages with the slit portion 72, so that a longitudinal position thereof relative to the cartridge B is determined. With respect to a widthwise direction, a free end portion 100*c* of the memory tag 100 is abutted against a contact portion 72*a* of the slit portion 72 to determine the position of the memory tag 100 (FIG. 9).

In this state, meltable ribs 73 provided at an entrance of the slit portion 72 are heat-melted by using an impulse welder or the like. In a state in which the meltable ribs 73 are melted so as to prevent disconnection of the memory tag 100, a meltable portion is cooled and solidified. As a result, the memory tag 100 is mounted on the cleaning frame 71. Further, at an outside portion of each of the portions of the memory tag 100 with respect to the longitudinal direction of the cartridge B, connector positioning holes 86 are provided.

(Main Assembly Electrical Contact)

Figure 11:
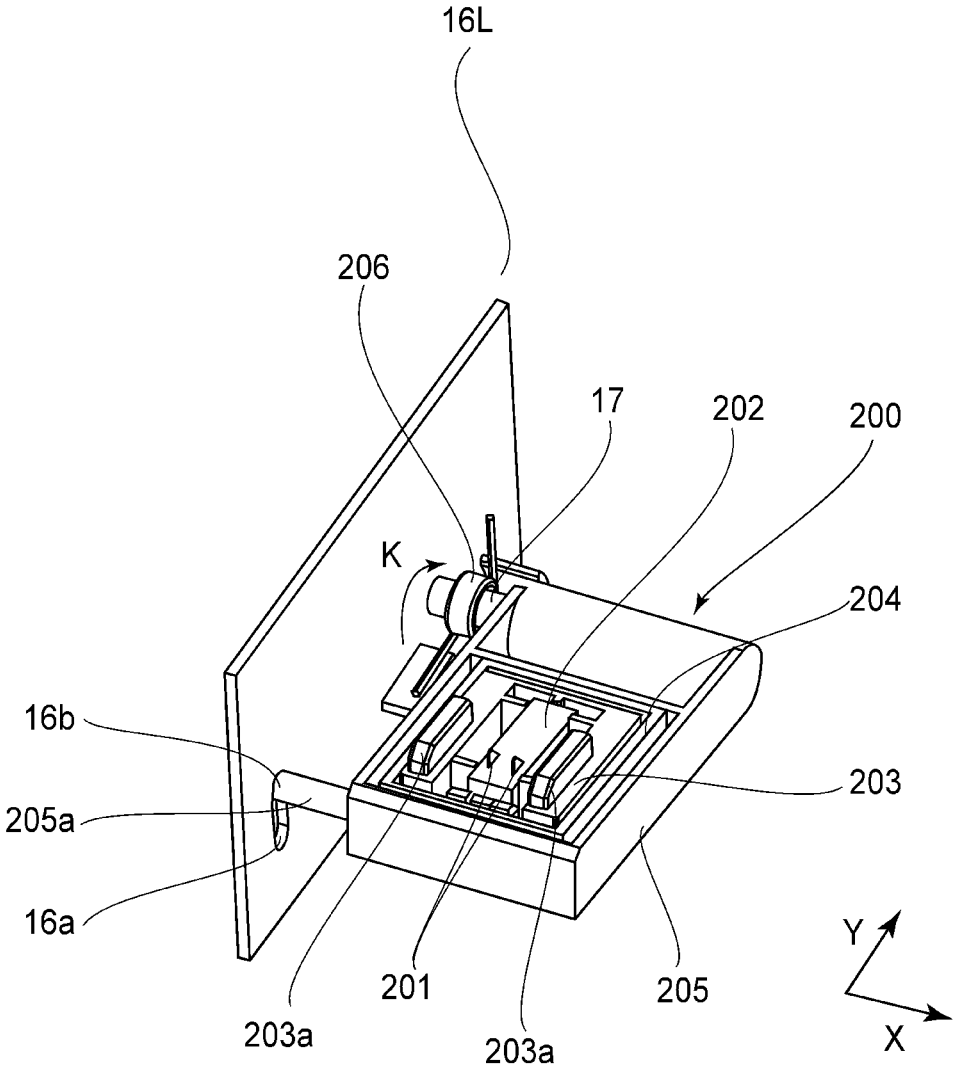
FIG. 11 is a perspective view for illustrating a structure of a main assembly electrical contact unit.

As shown in (a) of FIG. 10, at the cartridge mounting portion A1 in the apparatus main assembly A, a main assembly electrical contact unit 200 is provided in the non-driving side. A state of the main assembly electrical contact unit 200 and a periphery thereof are shown in FIG. 11. As shown in FIG. 11, a connector 202 including the main assembly electrical contacts 201 is locked in a connector holder 203. The connector holder 203 is provided with holder positioning projections 203*a*. The connector holder 203 is locked in a holder cover 204 movably in an arrow Y direction (front-rear direction) in FIG. 11. Further, the holder cover 204 is locked in a base cover 205 movably in an arrow X direction (left-right direction) in FIG. 11.

The base cover 205 is provided rotatably about a rotation shaft 17 provided on a side plate 16L of the apparatus main assembly A in the non-driving side, and is rotationally urged in an arrow K direction (raising direction) by an urging spring 206. Further, the base cover 205 is provided with a rotation preventing boss 205*a* and is inserted into a guide hole 16*a* of the side plate 16L, thus guiding motion thereof around the rotation shaft 17.

During a free state of the base cover 205 shown in FIG. 11, the rotation preventing boss 205*a* contacts a rotation preventing surface 16*b* as an upper end of the guide hole 16*a*, and further upward movement thereof is limited, so that a raising movement position of the base cover 205 with respect to the arrow K direction in FIG. 11 is determined. That is, the connector 202 is supported movably in the arrow X and Y directions and rotatably in the arrow K direction in FIG. 11 while being urged.

(Mounting and Demounting of Cartridge)

Mounting and demounting of the cartridge B relative to the apparatus main assembly A will be described. In the image forming apparatus 1 in Embodiment 1, as shown in FIG. 2 and (a) of FIG. 10, to the apparatus main assembly A, the openable door 13 capable of opening a substantially upper half portion of the apparatus main assembly A in the front side and a substantially front half portion in an upper side is provided. The openable door 13 is provided, openably about a hinge portion (rotation center) 13*a*, to the apparatus main assembly A. The openable door 13 is rotatable, about the hinge portion 13*a*, to a closed position W1 where the openable door 13 is caused to fall in the front direction relative to the apparatus main assembly A as shown in FIG. 2 and to an opened position W2 where the openable door 13 is raised upward and rearward when being viewed from the front side as shown in (a) of FIG. 10.

The closed state of the openable door 13 is held by a locking means (not shown). By holding a grip portion 13*b* of the openable door 13 with fingers and then moving a lock-releasing member provided to the grip portion 13*b*, a locked state is eliminated, so that the openable door 13 can be moved from the closed position W1 to the opened position W2. When the openable door 13 is moved from the closed position W1 to the opened position W2, the openable door 13 is held at the opened position W2 by a standing force of a stand member 13*c*. By this opening operation of the openable door 13, as shown in (a) of FIG. 10, an opening (portion) A2 formed at the substantially upper half portion in the front side and the substantially front half portion in the upper side is exposed.

This opening A2 has a size such that the cartridge B can pass through the opening A2 when the cartridge B is inserted into the cartridge mounting portion A1 in the apparatus main assembly A and that the cartridge B can pass through the opening A2 toward an outside of the apparatus main assembly A. The mounting and demounting of the cartridge B relative to the apparatus main assembly A are carried out in a state in which the openable door 13 is opened as shown in (a) of FIG. 10.

Further, in the state in which the cartridge B is mounted at the mounting position C, the mounted cartridge B is exposed through the opening A2 in the developing device unit 20 side. In a state in which the cartridge B is not mounted, the cartridge mounting portion A1 is in sight ((a) of FIG. 10).

The driving force outputting portion A3 ((b) of FIG. 10) in the driving side of the apparatus main assembly A is changed in state, by an operation of an interrelating mechanism (not shown) interrelated with the opening and closing movement of the openable door 13, to a state in which the driving force outputting portion A3 is projected toward the cartridge mounting portion A1 side in a predetermined manner and to a state in which the driving force outputting portion A3 is retracted from the cartridge mounting portion A1 side. During the closed state of the openable door 13, the driving force outputting portion A3 is in the retracted state from the cartridge mounting portion A1 side.

Accordingly, in the case where the cartridge B is mounted at the mounting position C, the connection of the driving force outputting portion A3 in the apparatus main assembly A side with the driving force receiving portion 63*a* of the cartridge B is eliminated in interrelation with the movement of the openable door 13 from the closed position W1 to the opened position W2. As a result, a state in which the cartridge B can be taken out from the cartridge mounting portion A1 is created.

As shown in (a) and (b) of FIG. 10, at the cartridge mounting portion A1 in the apparatus main assembly A, the side plate 16L in the non-driving side and a side plate 16R in the driving side are provided with cartridge guiding members 12L and 12R, respectively. The cartridge guiding members 12L and 12R guide the cartridge B in a mounting direction and a demounting direction when the cartridge B is mounted to and demounted from the cartridge mounting portion A1.

In this embodiment, each of the cartridge guiding portions 12L and 12R in the non-driving side and the driving side has an upper guiding surface 12*a* and a lower guiding groove 12*b*, and these cartridge guiding members 12L and 12R provide a substantially bilaterally symmetrical constitution. The upper guiding surface 12*a* and the lower guiding groove 12*b* are disposed in parallel to each other and are inclined obliquely downward when they are viewed from the front side of the apparatus main assembly A.

With respect to the cartridge guiding member 12L in the non-driving side, the first positioning projection 87 of the cartridge B in the non-driving side is engaged in and guided along the lower guiding groove 12*b*, and the second positioning projection 88 rides on and is guided along the upper guiding surface 12*a*. With respect to the cartridge guiding member 12R in the driving side, the first positioning projection 87 of the cartridge B in the driving side is engaged in and guided along the lower guiding groove 12*b*, and the second positioning projection 88 rides on and is guided along the upper guiding surface 12*a*.

The cartridge B is mounted into the cartridge mounting portion A1 in the following manner. In the case where the cartridge B to be mounted is a new one, in the developing device unit 20, the toner chamber 29 and the toner supplying chamber 28 are partitioned by the toner seal member 45. Therefore, in (a) of FIG. 1, an end portion of the toner seal member 45 projected to the outside from the first side member 26L of the developing device unit 20 is held and pulled off to be removed. As a result, the toner T is supplied from the toner chamber 29 into the toner supplying chamber 28.

The openable door 13 of the apparatus main assembly A is opened to open the opening A2. The cartridge B is gripped in the developing device unit 20 side and then is inserted into the cartridge mounting portion A1 through the opening A2 with the cleaning unit 60 side rearward. That is, the cartridge B is inserted into the cartridge mounting portion A1 in a state in which the cartridge B is directed rearward in the cleaning unit 60 side, leftward in the non-driving side, and rightward in the driving side with respect to a direction perpendicular to the longitudinal direction (the rotational axis direction of the drum 62).

Then, the first positioning projection 87 and the second positioning projection 88 in each of the non-driving side and the driving side of the cartridge B are engaged with the lower guiding groove 12*b* and the upper guiding surface 12*a* of associated one of the cartridge guiding members 12L and 12R in the non-driving side and the driving side of the cartridge mounting portion A1. Further, the cartridge B is moved in the insertion direction G while the first positioning projection 87 and the second positioning projection 88 are guided along the lower guiding groove 12*b* and the upper guiding surface 12*a*, respectively.

Figure 12:
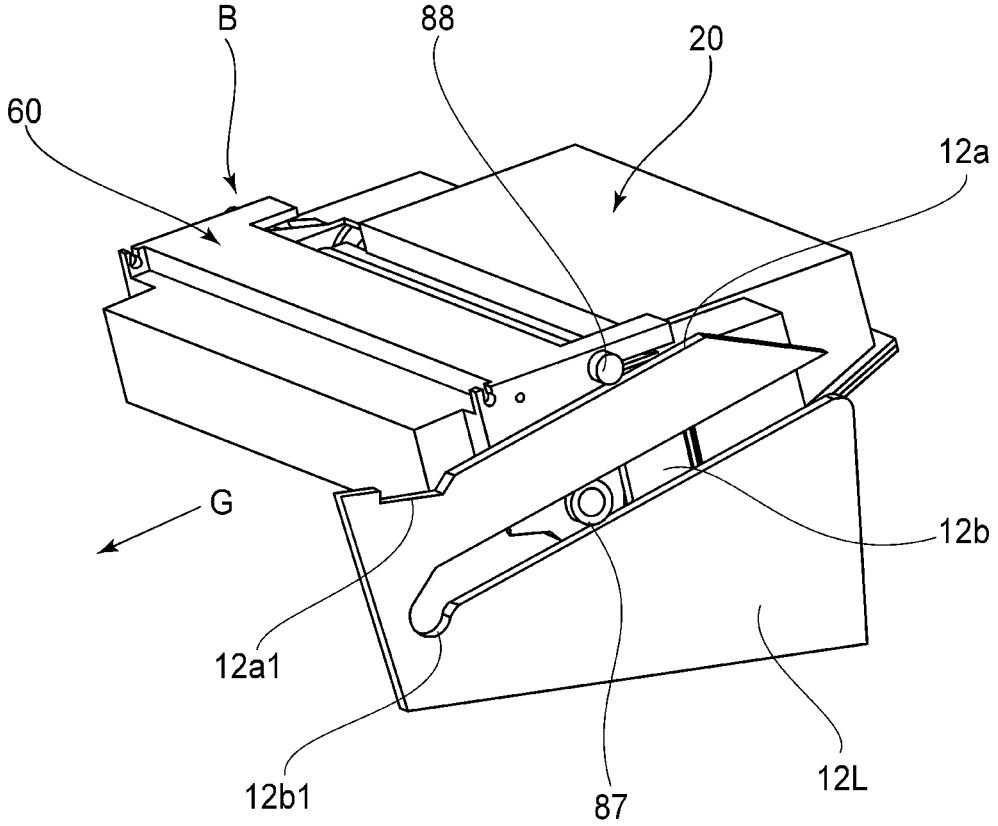
FIGS. 12 and 13 are perspective views for illustrating mounting of the process cartridge relative to the apparatus main assembly.
Figure 13:
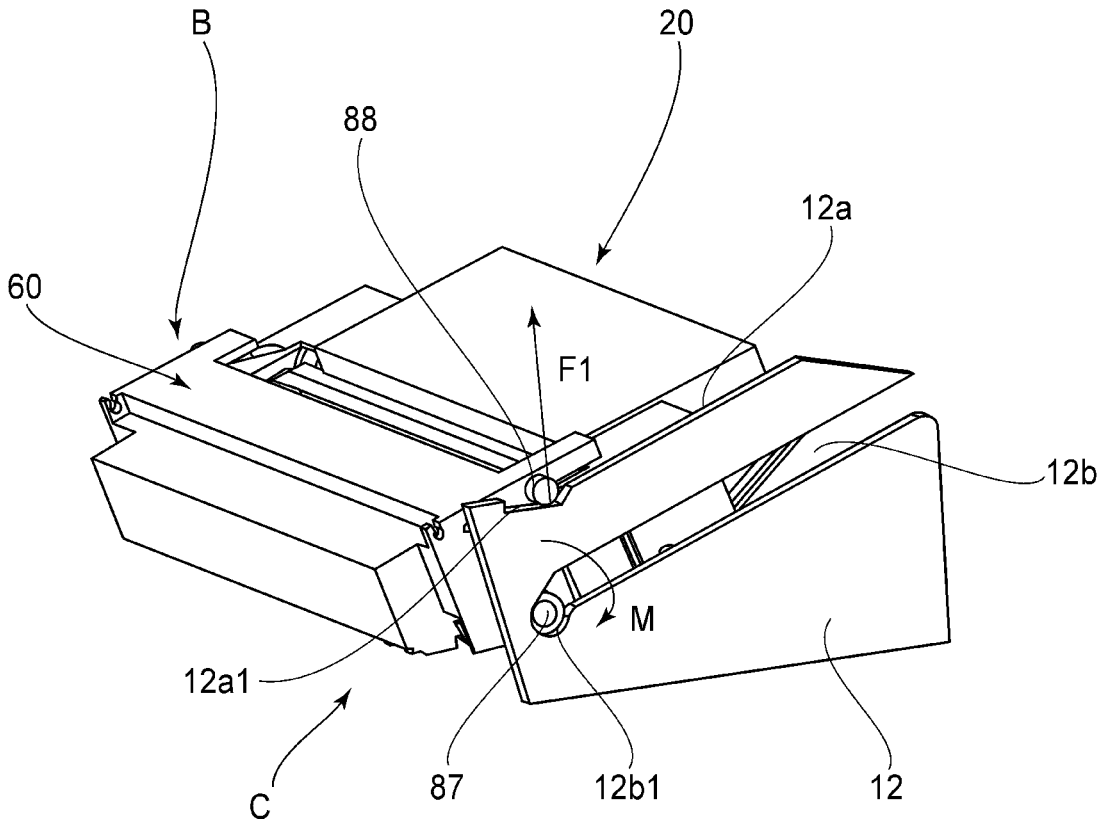

A state in which the cartridge B is mounted into the cartridge mounting portion A1 will be described with reference to FIGS. 12 and 13. FIGS. 12 and 13 are perspective views showing a mounting process in the non-driving side, but a similar mounting process is performed also in the driving side. Incidentally, in FIGS. 12 and 13, for facilitating explanation, a part (e.g., the protective member 79) of components is omitted.

As shown in FIG. 12, the mounting of the cartridge B is made by being inserted so that the second positioning projection 88 is guided along the upper guiding surface 12*a* and the first positioning projection 87 is guided along the lower guiding groove 12*b*. As a result, the cartridge B is inserted into the apparatus main assembly A while an insertion locus thereof is limited by the upper guiding surface 12*a* and the lower guiding groove 12*b*.

When the cartridge B is further pushed in, as shown in FIG. 13, the first positioning projection 87 of the cartridge B drops into a receiving recessed portion 12*b*1 formed at a rear end of the lower guiding groove 12*b*, thus being positioned. Similarly, the second positioning projection 88 contacts a contact portion 12*a*1 formed, as a cartridge rotation preventing portion, at a rear end portion of the upper guiding surface 12*a*.

The center of gravitation of the cartridge B is positioned in the developing device unit 20 side than the first positioning projection 87, and therefore moment acts on the cartridge B around the first positioning projection 87 in a direction indicated by an arrow M in FIG. 13. This moment is cancelled by reaction force F1 acting from the contact portion 12*a*1, to which the second positioning projection 88 is contacted, to the second positioning projection 88, so that the position of cartridge B with respect to the rotational direction is determined. In this way, the cartridge B is mounted at the mounting position (image forming position) C of the cartridge mounting portion A1 of the apparatus main assembly A.

The protective member 79 for the cartridge B operates from the closed state to the opened state by engagement with an engaging member (not shown) in the apparatus main assembly A side in an insertion movement process of the cartridge B relative to the cartridge mounting portion A1. In FIGS. 12 and 13, the protective member 79 is omitted from illustration.

The driving force outputting portion A3 in the apparatus main assembly A side is, as shown in (b) of FIG. 10, provided at a position corresponding to a receiving recessed portion 12 formed at the rear end of the lower guiding groove 12*b* of the cartridge guiding member 12R in the driving side. Further, as described above, during the opened state of the openable door 13, the driving force outputting portion A3 is in the retracted state from the cartridge mounting portion A1. That is, the driving force outputting portion A3 is in the retracted state from the receiving recessed portion 12*b*1.

Accordingly, when the first positioning projection 87 of the cartridge B in the driving side drops into the receiving recessed portion 12*b*1 formed at the rear end of the lower guiding groove 12*b*, the first positioning projection 87 does not interfere with the driving force outputting portion A3. Further, in a state in which the first positioning projection 87 drops in the receiving recessed portion 12*b*1, the first positioning projection 87 opposes the driving force outputting portion A3 where the driving force receiving portion 63*a* positioned inside the first positioning projection 87 is retracted.

Then, the openable door 13 is closed by being moved from the opened position W2 to the closed position W1 against the standing force of the stand member 13*c* and then is held by the locking means. In interrelation with the movement of the openable door 13 from the opened position W2 to the closed position W1, the driving force outputting portion A3 in the apparatus main assembly A side is projected and moved toward the cartridge mounting portion A1 side and then is placed in a connected state with the driving force receiving portion A3 in the apparatus main assembly A side. Further, in the state in which the cartridge B is mounted at the mounting position C, the electrode plates 81 and 27 in the cartridge B side contact the electric power supplying portions (not shown) in the apparatus main assembly A side. In this state, the image forming apparatus 1 is capable of performing an image forming operation.

The cartridge B mounted at the mounting position C is demounted in the following manner. The openable door 13 is opened to open the opening A2. By the opening operation of the openable door 13, the drive outputting portion A3 is retracted from the cartridge mounting portion A1 side, so that the connection with the driving force receiving portion 63*a* in the cartridge B side is eliminated. At the opened opening A2, the developing device unit 20 of the mounted cartridge B is exposed. Therefore, the developing device unit 20 is gripped and then the cartridge B is pulled and moved in a direction opposite to the insertion direction G.

By a pulling-out force, the first positioning projection 87 and the second positioning projection 88 in each of the non-driving side and the driving side ride from the receiving recessed portion 12*b*1 onto the lower guiding groove 12*b* and from the contact portion 12*a*1 onto the upper guiding surface 12*a*, respectively. Then, the cartridge B is moved in the demounting direction while the first positioning projection 87 and the second positioning projection 88 are guided along the lower guiding groove 12*b* and the upper guiding surface 12*a*, respectively.

As a result, the cartridge B is taken out to the outside from the apparatus main assembly A. The protective member 79 for the cartridge B operates from the opened state to the closed state by engagement with the engaging member (not shown) in the apparatus main assembly A side in a demounting movement process of the cartridge B from the cartridge mounting portion A1.

(Contact Between Main Assembly Electrical Contact and Memory Tag)

Next, contact between the main assembly electrical contacts 201 of the apparatus main assembly A and the memory (electrical) contacts 100*b* of the cartridge B will be described with reference to FIGS. 14 to 16. Incidentally, in these figures, for convenience of explanation a part (e.g., the protective member 79) of components is omitted from illustration.

Figure 14:
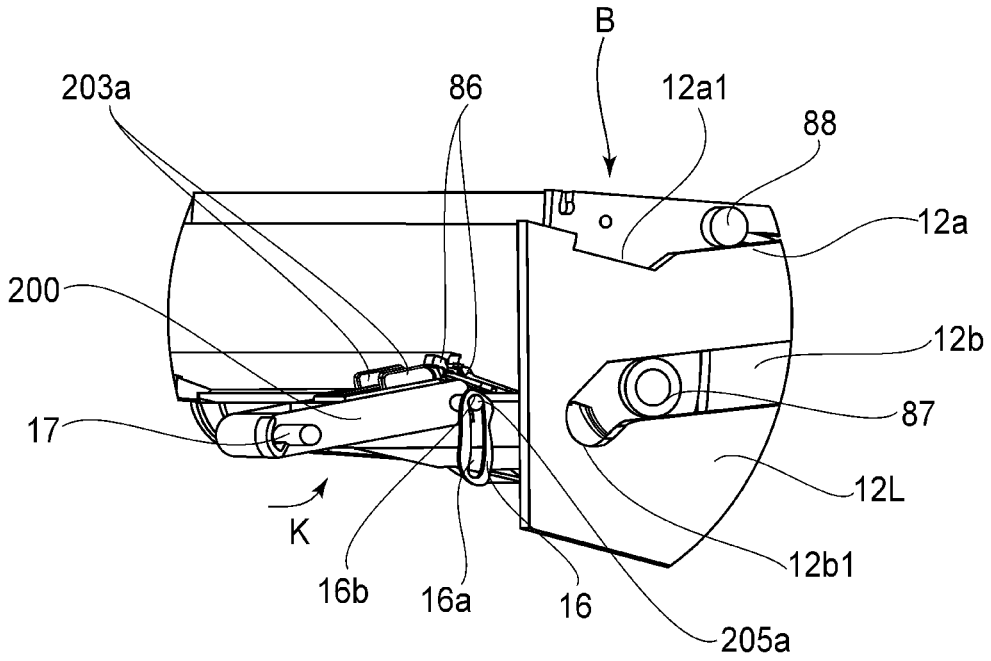
FIGS. 14, 15, (a) and (b) of FIG. 16 and FIG. 17 are perspective views for illustrating engagement between the main assembly electrical contact unit and the contact.

FIG. 14 is a perspective view of the cartridge B in the non-driving side during mounting of the cartridge B. As described above, the position of the main assembly electrical contact unit 200 is determined by contact of the rotation preventing boss 205*a* with the rotation preventing portion 16*b* provided on the side plate 16 while the main assembly electrical contact unit 200 is urged in the arrow K direction in FIG. 14.

Figure 15:
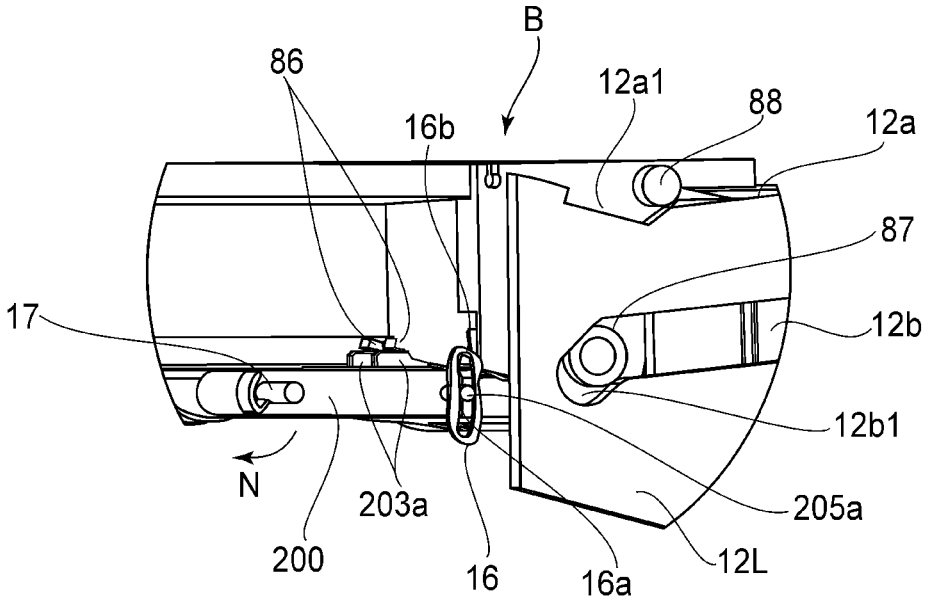

FIG. 15 is a perspective view of the cartridge B which is further moved in the mounting direction. As shown in FIG. 15, the cartridge B contacts the main assembly electrical contact unit 200, and the main assembly electrical contact unit 200 is rotated about the rotation shaft 17 in an arrow N direction in the figure. At the same time, the holder positioning projection 203*a* of the main assembly electrical contact unit 200 is gradually engaged with the connector positioning hole 86 of the cartridge B.

At this time, positions of the holder positioning projection 203*a* and the connector positioning hole 86 are deviated from each other due to play during the mounting of the cartridge B. However, as described above, the connector holder 203 is movable in the arrow X and Y directions shown in FIG. 11. Therefore, the holder positioning projection 203*a* is gradually moved and engaged so as to follow the connector positioning hole 86 of the cartridge B.

Figure 16:
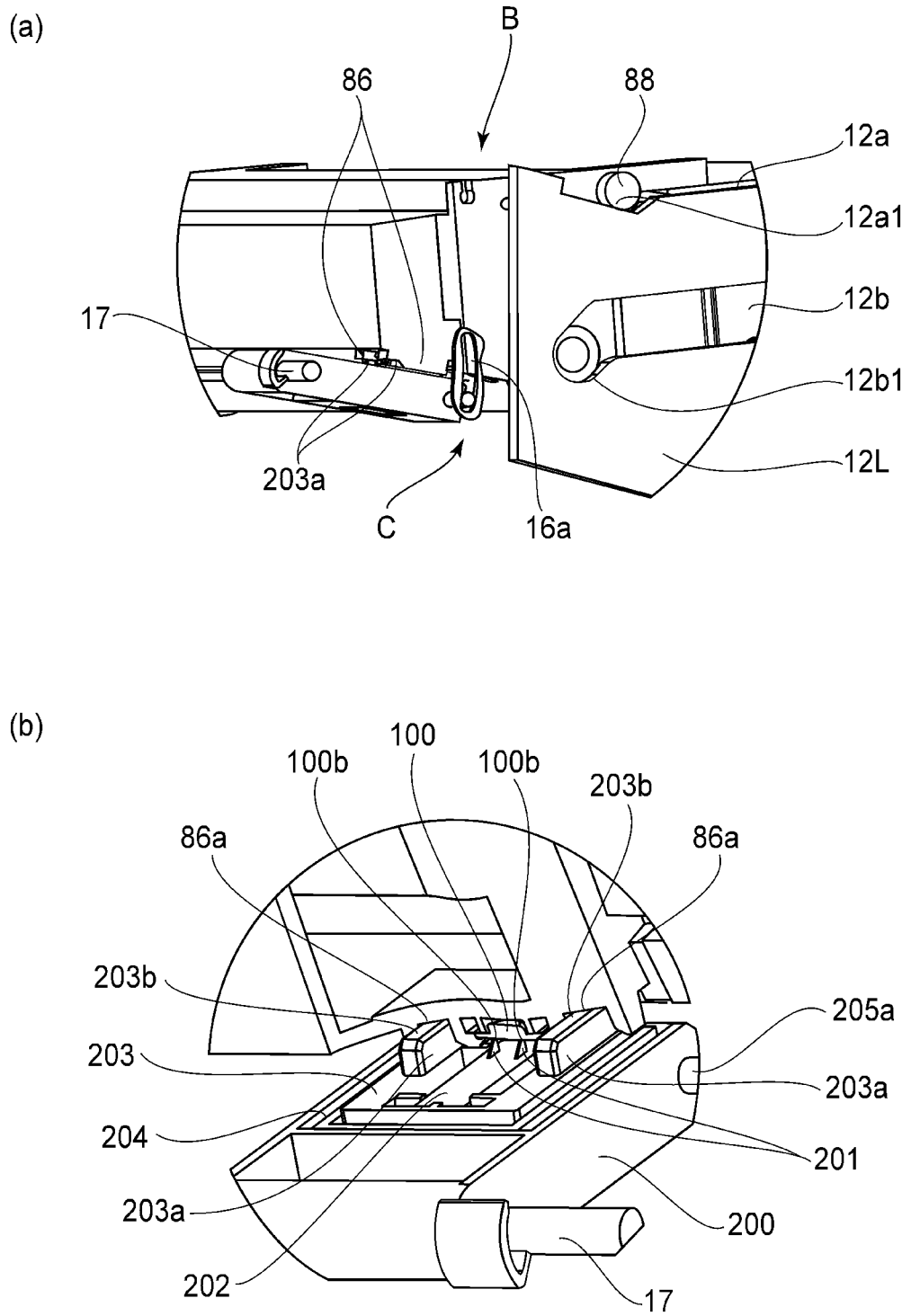

Then, as shown in (a) of FIG. 16, the first positioning projection 87 and the second positioning projection 88 in the cartridge B side drop in the receiving recessed portion 12*b*1 and the contact portion 12*a*1 in the apparatus main assembly A side, respectively, so that the cartridge B is mounted in the apparatus main assembly A. In this way, when the cartridge B is mounted, the holder positioning projection 203*a* of the main assembly electrical contact unit 200 is sufficiently engaged with the connector positioning hole 86 of the cartridge B.

A sectional view of the main assembly electrical contact unit 200 at this time is shown in (b) of FIG. 16. An end 203*b* of the holder positioning projection 203*a* of the main assembly electrical contact unit 200 contacts a bottom 86*a* of the connector positioning hole 86 of the cartridge B. Further, the main assembly electrical contacts 201 of the connector 202 contact the memory contacts 100*b*.

Figure 17:
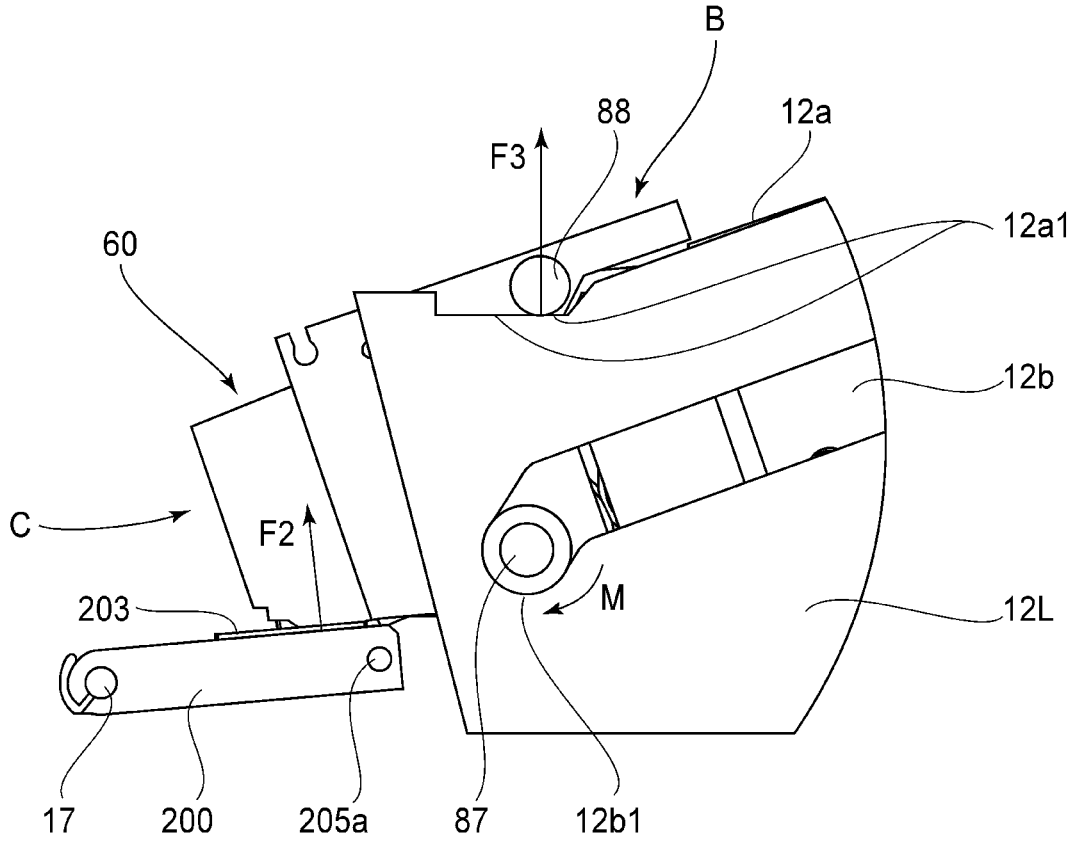

Here, an urging force F2 (FIG. 17) by the urging spring 206 described with reference to FIG. 11 acts on the cartridge B from the ends 203*b* of the holder positioning projections 203*a* provided at two positions and from the main assembly electrical contacts 201 provided at two positions. This urging force acts on the cartridge B as shown in FIG. 17, and generates moment around the first positioning projection (positioning boss) 87 in the arrow M direction in the figure. This moment is cancelled by moment generated by reaction force F3 acting on the second positioning projection 88 from the contact portion 12*a*1 to which the second positioning projection 88 is contacted.

In other words, the rotation preventing portion 16*b* for the cartridge B is disposed at a position where the reaction force F3 directed in a direction of cancelling the moment generated in the cartridge B by the urging force of the main assembly electrical contact unit 200 acts on the cartridge B. The moment of the cartridge B by the urging force from the main assembly electrical contacts 201 is canceled, so that stable contact of the memory tag contacts 100*b* provided on the cartridge B with the main assembly electrical contacts 201 provided in the apparatus main assembly A of the image forming apparatus 1 is realized.

According to this constitution, even when the moment acts on the cartridge B by the urging force from the main assembly electrical contact unit 200, the moment is canceled by the reaction force F3, from the contact portion 12*a*1, acting on the second positioning projection 88. For that reason, at attitude of the cartridge B can be stabilized. Further, by the stabilized attitude of the cartridge B, it is possible to realize stable contact between the memory contacts 100*b* of the cartridge B and the main assembly electrical contacts 201 of the main assembly electrical contact unit 200.

As described above, according to Embodiment 1, even when the urging force acts on the cartridge B from the main assembly electrical contacts 201, the attitude of the cartridge B can be stabilized. Further, the memory contacts 100*b* connected with the memory 100*a* of the cartridge B and the main assembly electrical contacts 201 of the connector 202 provided in the apparatus main assembly A can be stably contacted to each other.

Embodiment 2

Figure 18:
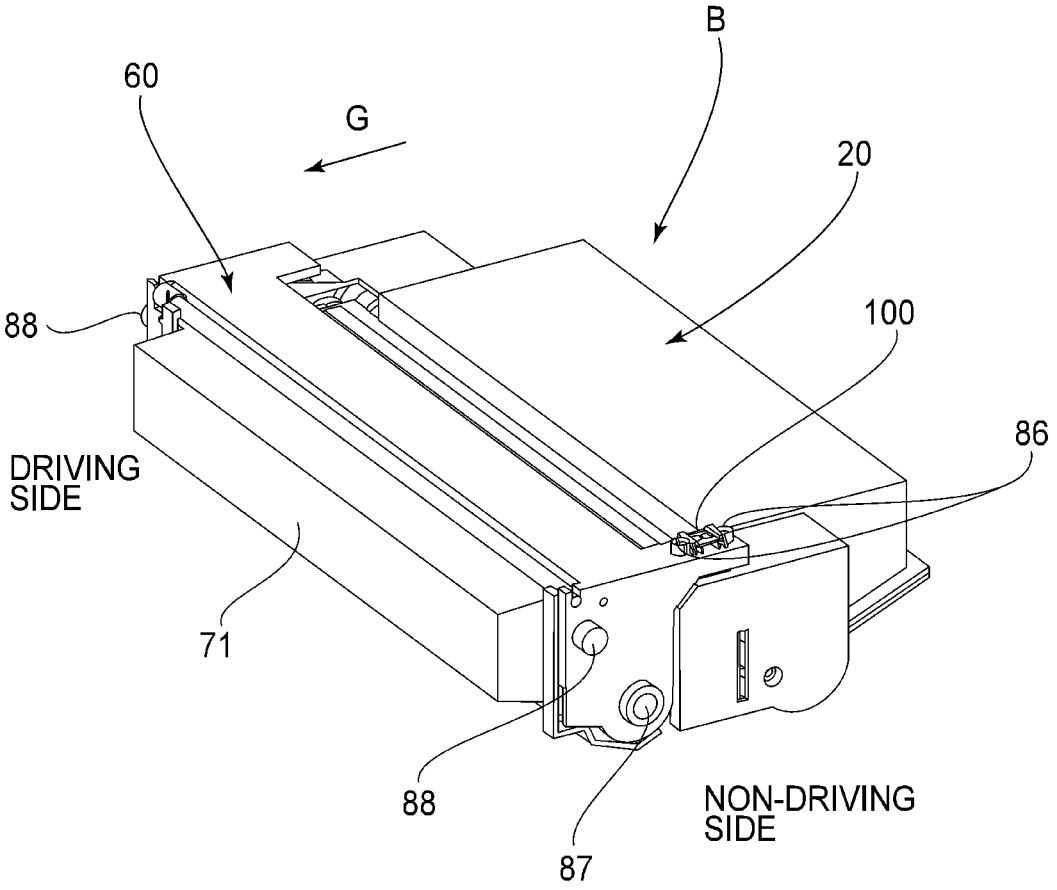
FIG. 18 is a perspective view of a process cartridge in Embodiment 2.

FIG. 18 is a perspective view showing an outer appearance of a cartridge B in this embodiment. The cartridge B is only different from the cartridge B in Embodiment 1 in that the second positioning projections 88 in the non-driving side and the driving side and the memory tag 100 are provided at positions different from those in Embodiment 1. Other cartridge B constitutions are the same as those in Embodiment 1, and therefore will be omitted from redundant description.

In the case of the cartridge B in this embodiment, the second positioning projections 88 in the non-driving side and the driving side are provided in the following manner. That is, as shown in FIG. 18, the second positioning projections 88 are provided at outer surfaces of the side plates of the cleaning frame 71 in the non-driving side and the driving side so as to be positioned downstream of the first positioning projections 87, provided coaxially with the drum 62, with respect to the insertion direction G of the cartridge B and so as to be positioned above the first positioning projections 87.

Further, the memory tag 100 is provided at an upper surface of the cleaning frame 71 in the non-driving side and upstream of the first positioning projections 87 with respect to the insertion direction G of the cartridge B. Further, the memory tag 100 is provided with connector positioning holes 86 at end portions thereof.

Figure 19:
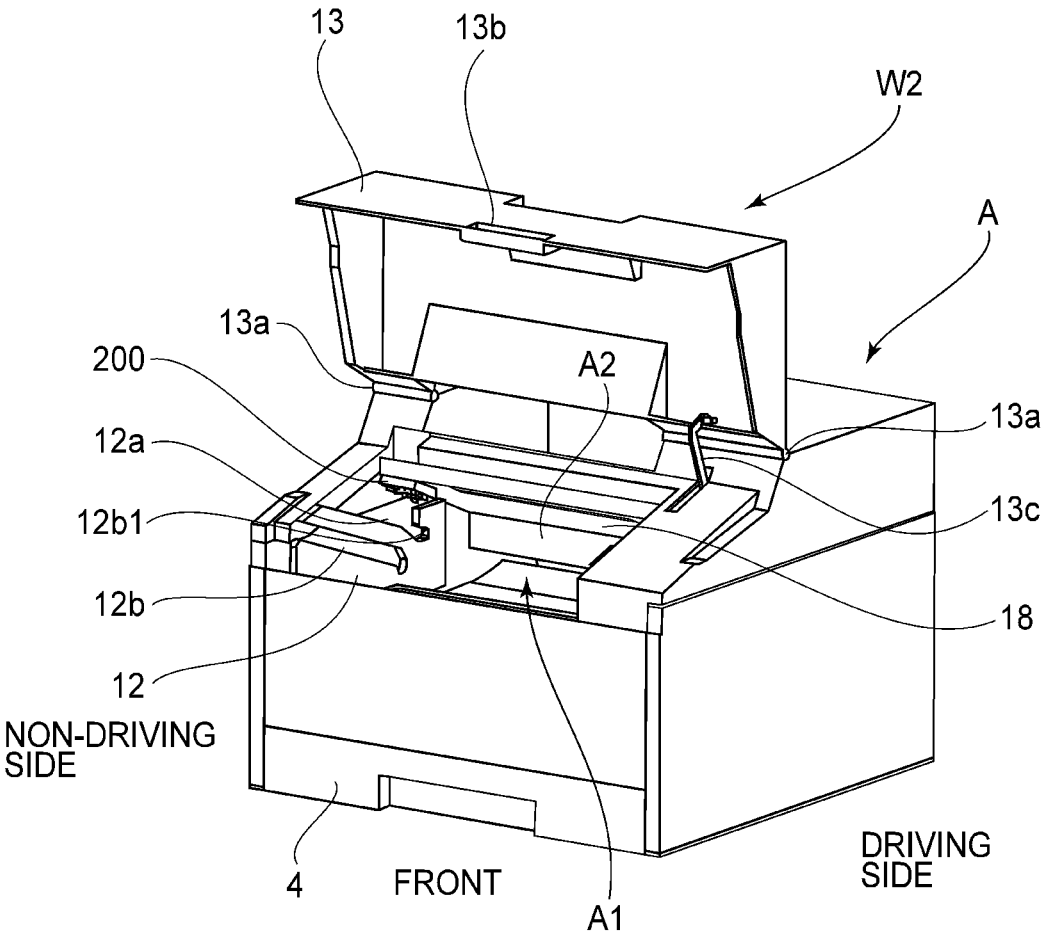
FIG. 19 is a perspective view of an apparatus main assembly in a state in which an openable door is opened.

FIG. 19 is a perspective view of an apparatus main assembly A of an image forming apparatus 1 in this embodiment, and shows a state in which the opening A2 where the openable door 13 is opened is open and in which the cartridge B is not mounted into the cartridge mounting portion A1. As shown in FIG. 19, the main assembly electrical contact unit 200 is provided on a top plate 18 of the apparatus main assembly A so that the main assembly electrical contacts 201 are directed downward. In this embodiment, constituent elements similar to those in Embodiment 1 are represented by the same reference numerals or symbols and will be omitted from redundant description. Also the mounting and demounting constitution and manner of the cartridge B relative to the cartridge mounting portion A1 are similar to those in Embodiment 1, and therefore will be omitted from redundant description.

Figure 20:
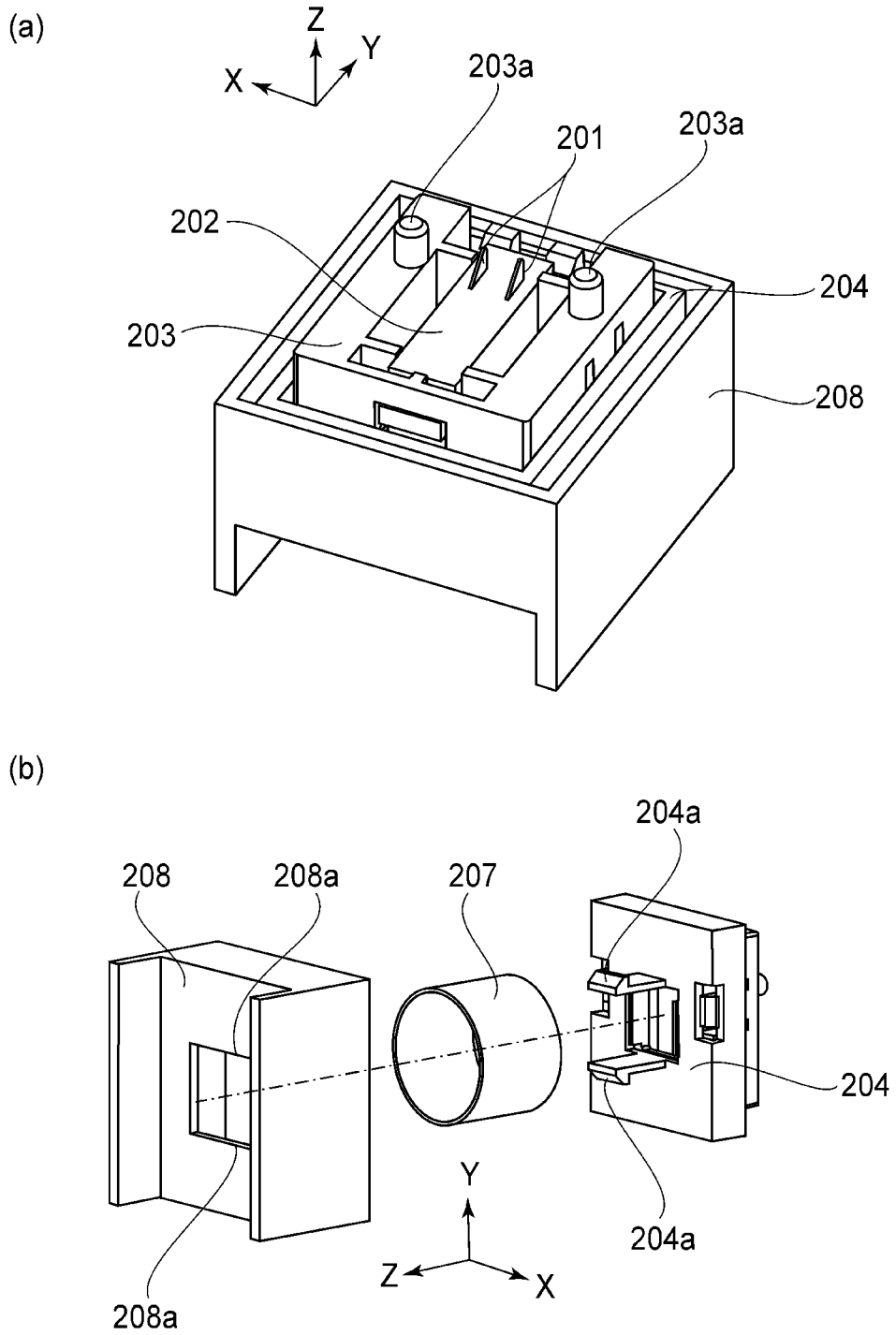
In FIG. 20, (*a*) and (*b*) are perspective views for illustrating a main assembly electrical contact unit.

In FIG. 20, (*a*) is a perspective view showing an outer appearance of a main assembly electrical contact unit 200. As shown in (a) of FIG. 20, a connector 202 including the main assembly electrical contacts 201 is locked in a connector holder 203. The connector holder 203 is provided with holder positioning projections 203*a*. The connector holder 203 is locked in a holder cover 204 movably in an arrow Y direction (front-rear direction) in (a) of FIG. 20. Further, the holder cover 204 is locked in a base cover 208 movably in an arrow X direction in (a) of FIG. 20.

In FIG. 20, (*b*) is an exploded perspective view of the main assembly electrical contact unit 200. As shown in (b) of FIG. 20, an urging spring 207 is provided between a base cover 208 and a holder cover 204. In an assembled state of those members, two claw portions 204*a* of the holder cover 204 are engaged with edge line portions 208*a* of the base cover 208.

Further, the holder cover 204 is movable relative to the base cover 208 while being urged in an arrow Z direction in (a) and (b) of FIG. 20. Further, a width of the edge line portion 208*a* is set so as to be larger than a width of the claw portion 204*a*, so that the holder cover 204 is movable relative to the base cover 208 in an arrow X direction in (a) and (b) of FIG. 20.

That is, the connector 202 is movable relative to the base cover 208 in arrow X, Y and Z directions in (a) and (b) of FIG. 20, and is locked in an urged state in the arrow Z direction in the figures.

(Contact Between Main Assembly Electrical Contacts and Memory Tag)

Figure 21:
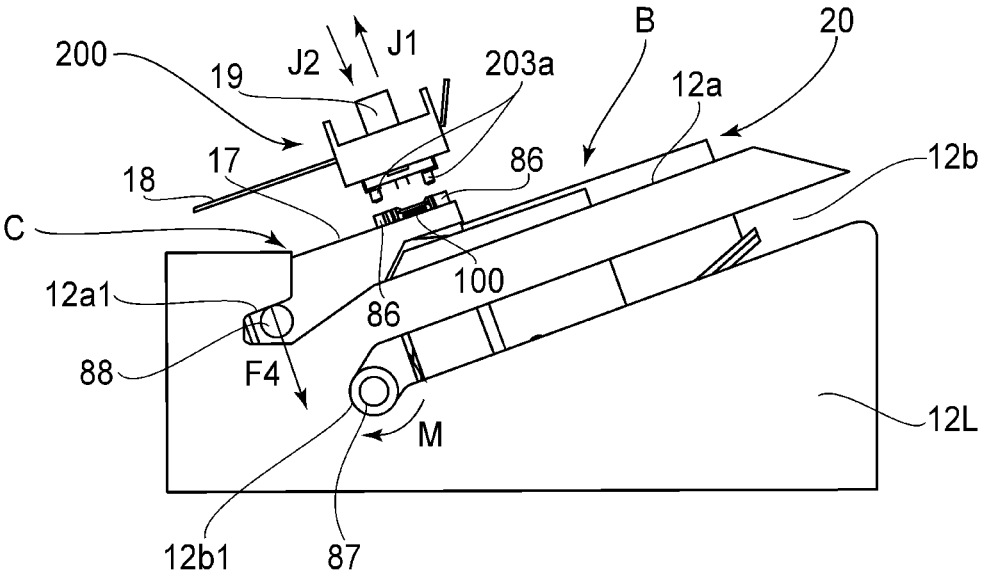
FIGS. 21 and 22 are side views for illustrating mounting of the process cartridge relative to the apparatus main assembly.
Figure 22:
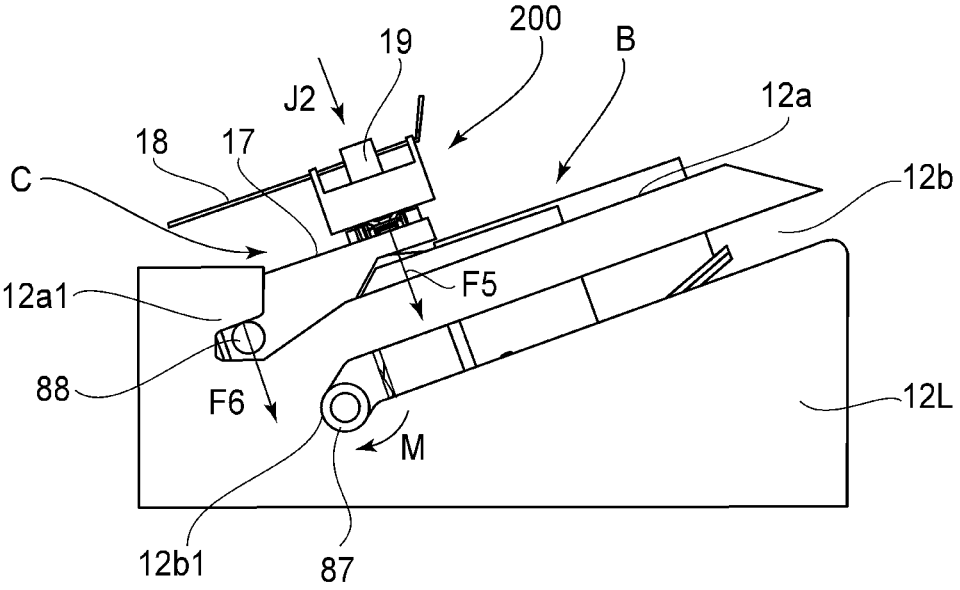

With reference to FIGS. 21 and 22, a state in which the cartridge B is mounted at the mounting position C will be described. FIGS. 21 and 22 are schematic views for illustrating mounting of the cartridge B in the non-driving side, but a similar mounting process is performed also in the driving side. The main assembly electrical contact unit 200 is provided to the top plate 18 of the apparatus main assembly A. Further, a link mechanism (not shown) engaged with the openable door 13 is engaged with the main assembly electrical contact unit 200 via an engaging member 19, so that the main assembly electrical contact unit 200 is supported movably in an arrow J1 direction in the figures when the openable door 13 is opened and movably in an arrow J2 direction in the figures when the openable door 13 is closed.

As shown in FIG. 21, when the cartridge B is located at the mounting position C, the center of gravitation of the cartridge B is positioned in the developing device unit 20 side than the first positioning projection 87, and therefore moment acts on the cartridge B around the first positioning projection 87 in a direction indicated by an arrow M in FIG. 21. This moment is cancelled by reaction force F4 acting from the contact portion 12*a*, to which the second positioning projection 88 is contacted, to the second positioning projection 88, so that the position of cartridge B with respect to the rotational direction is determined.

FIG. 22 shows a closed state of the openable door 13. When the openable door 13 is closed, via the engaging member 19, the main assembly electrical contact unit 200 is pressed in the arrow J2 direction in the figure by the link mechanism (not shown) engaged with the openable door 13. In this way, the holder positioning projection 20*a* of the main assembly electrical contact unit 200 is engaged with the connector positioning hole 86 of the cartridge B.

At this time, the holder positioning projection 203*a* and the connector positioning hole 86 start engagement therebetween in a state in which positions thereof are deviated from each other due to play during the mounting of the cartridge B. However, as described above, the connector holder 203 is movable in the arrow X and Y directions shown in FIG. 11. Therefore, the holder positioning projection 203*a* is gradually moved and engaged so as to follow the connector positioning hole 86 of the cartridge B.

Figure 23:
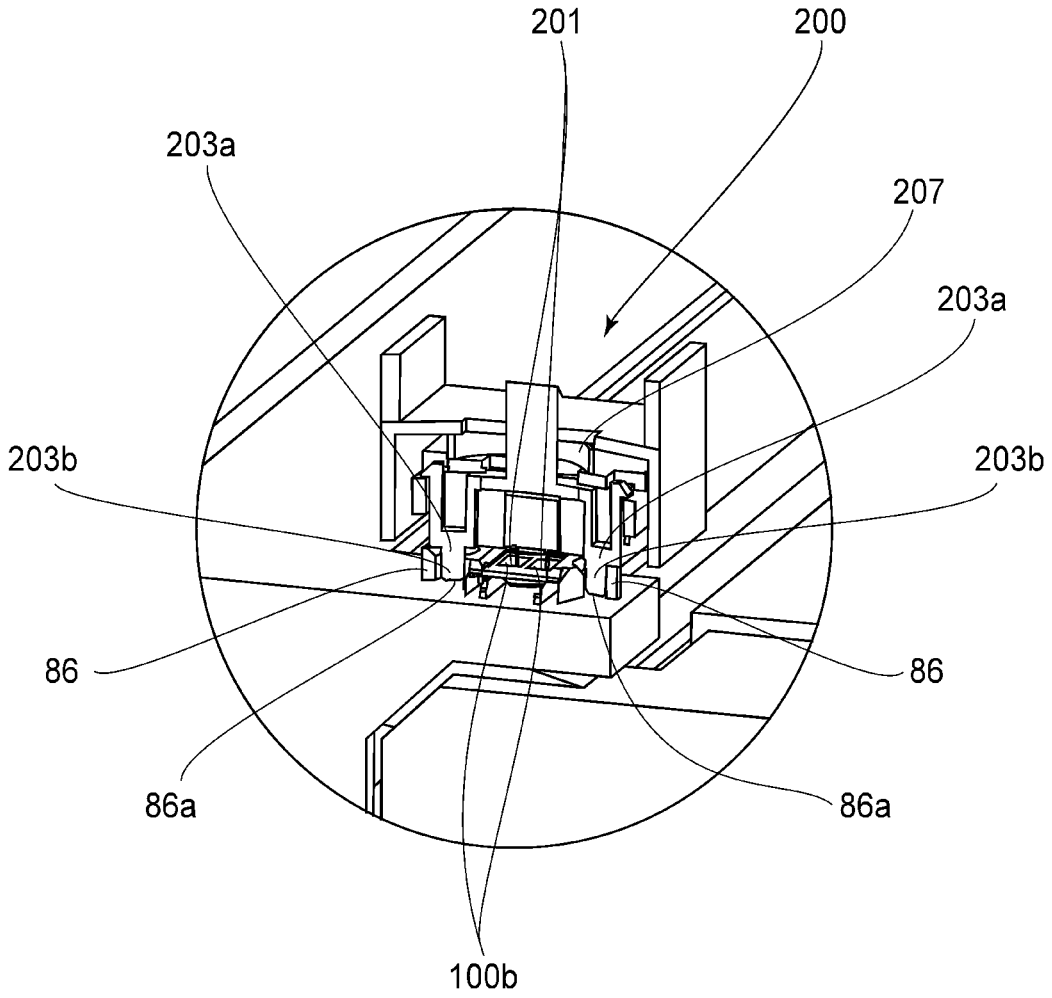
FIG. 23 is a perspective view for illustrating engagement between the main assembly electrical contact unit and the process cartridge.

A perspective view of the main assembly electrical contact unit 200 at this time is shown in FIG. 23, in which a part of components is omitted. As shown in FIG. 23, the end 203*b* of the holder positioning projection 203*a* of the main assembly electrical contact unit 200 contacts a bottom 86*a* of the connector positioning hole 86 of the cartridge B. Further, the main assembly electrical contacts 201 of the connector 202 contact the memory contacts 100*b*.

At this time, the urging force by the urging spring 207 described with reference to (b) of FIG. 20 acts on the cartridge B from the ends 203*b* of the holder positioning projections 203*a* provided at two positions and from the main assembly electrical contacts 201 provided at two positions.

In FIG. 22, an urging force F5 by the urging spring 207 is shown. This urging force F5 acts on the cartridge B, and generates moment around the first positioning projection 87 in the arrow M direction in the figure. This moment is cancelled by moment generated by reaction force F6 acting on the second positioning projection 88 from the contact portion 12*a*1 to which the second positioning projection 88 is contacted.

In other words, also in Embodiment 2, the rotation preventing portion 16*b* for the cartridge B is disposed at a position where the reaction force F6 directed in a direction of cancelling the moment generated in the cartridge B by the urging force F5 of the main assembly electrical contact unit 200 acts on the cartridge B. The moment of the cartridge B by the urging force from the main assembly electrical contacts 201 is canceled, so that stable contact of the memory contacts 100*b* provided on the cartridge B with the main assembly electrical contacts 201 provided in the apparatus main assembly A of the image forming apparatus 1 is realized.

According to this constitution, even when the moment acts on the cartridge B by the urging force F5 from the main assembly electrical contact unit 200, the moment is canceled by the reaction force F6, from the contact portion 12*a*1, acting on the second positioning projection 88. For that reason, at attitude of the cartridge B can be stabilized.

Further, the urging force F5 and reaction force F6 acting on the cartridge B from the main assembly electrical contact unit 200 acts in the downward direction in FIG. 22, and therefore the first positioning projection 87 of the cartridge B is strongly urged to the receiving recessed portion 12*b*1 of the cartridge guiding member 12L in the non-driving side. As a result, the position of the cartridge B is held further stably. That is, positioning of the cartridge B relative to the apparatus main assembly A can be stably performed.

Further, by the stabilized attitude of the cartridge B, it is possible to realize stable contact between the memory contacts 100*b* of the cartridge B and the main assembly electrical contacts 201 of the main assembly electrical contact unit 200.

Further, in this constitution, the main assembly electrical contacts 201 of the apparatus main assembly A are provided downward from above, and therefore deposition of a foreign matter, dust and the like on the main assembly electrical contacts 201 can be alleviated, so that it is possible to prevent improper electrical conduction of the contacts and operations resulting from short-circuit.

As described above, according to Embodiment 2, even when the urging force acts on the cartridge B from the main assembly electrical contacts 201, the attitude of the cartridge B can be stabilized. Further, the memory contacts 100*b* connected with the memory 100*a* of the cartridge B and the main assembly electrical contacts 201 of the connector 202 provided in the apparatus main assembly A can be stably contacted to each other.

Further, in this constitution, the connector 202 is disposed at the upper portion of the apparatus main assembly A, and the main assembly electrical contacts 201 are disposed downward, and therefore a contaminant, a foreign matter and the like are not readily deposited on the main assembly electrical contacts 201, so that it is possible to realize further stable contact of the main assembly electrical contacts 201.

The constitutions of the cartridges B in Embodiments 1 and 2 described above are summarized as follows. Each of the cartridges B includes the receiving recessed portions 12*b*1, the contact portions 12*a*1 and the main assembly electrical contacts 201, and is detachably mounted in the apparatus main assembly A of the image forming apparatus 1 for forming the image on the recording material P, thus contributing to the image forming process for forming the image on the recording material P.

The cartridge B includes, in the state in which the cartridge B is mounted at the image forming position of the apparatus main assembly A, the first positioning projections 87 held by the receiving recessed portions 12*b*1 and the second positioning projections 88 which are disposed at positions different from the positions of the first positioning projections 87 and which contact the contact portions 12*a*1. Further, the cartridge B includes the information storing member 100 having the storing element 100*a* for storing information and the storing element contacts 100*b* which are electrically connected with the storing element 100*a* and which are contactable to the main assembly electrical contacts 201.

Further, the constitution such that the moment, about the first positioning projection 87, acting on the cartridge B by the urging acting from the main assembly electrical contacts 201 to the storing element contacts 100*b* acts in the direction of urging the second positioning projection 88 toward the contact portion 12*a*1 is employed.

The constitution of the image forming apparatus 1 is summarized as follows. The image forming apparatus 1 forms the image on the recording material P. The image forming apparatus 1 includes the receiving recessed portions 12*b*1, the contact portions 12*a*1, the main assembly electrical contacts 201 and the cartridge B which is detachably mountable to the apparatus main assembly A thereof and which contributes to the image forming process for forming the image on the recording material P.

The cartridge B includes, in the state in which the cartridge B is mounted at the image forming position of the apparatus main assembly A, the first positioning projections 87 held by the receiving recessed portions 12*b*1 and the second positioning projections 88 which are disposed at positions different from the positions of the first positioning projections 87 and which contact the contact portions 12*a*1. Further, the cartridge B includes the information storing member 100 having the storing element 100*a* for storing information and the storing element contacts 100*b* which are electrically connected with the storing element 100*a* and which are contactable to the main assembly electrical contacts 201.

Further, the constitution such that the moment, about the first positioning projection 87, acting on the cartridge B by the urging acting from the main assembly electrical contacts 201 to the storing element contacts 100*b* acts in the direction of urging the second positioning projection 88 toward the contact portion 12*a*1 is employed.

The constitution of the apparatus main assembly A is summarized as follows. The image forming apparatus 1 forms the image on the recording material P. The cartridge B is detachably mountable to the apparatus main assembly A as a main assembly of the image forming apparatus 1 for forming the image on the recording material P.

The cartridge B includes the first positioning projections 87 and the second positioning projections 88 which are disposed at positions different from the positions of the first positioning projections 87. Further, the cartridge B includes the information storing member 100 having the storing element 100*a* for storing information and the storing element contacts 100*b* which are electrically connected with the storing element 100*a*.

The apparatus main assembly A includes, in the state in which the cartridge B is mounted at the mounting position C, the receiving recessed portions 12*b*1 for holding the first positioning projections 87, the contact portions 12*a*1 contactable to the second positioning projections 88, and the main assembly electrical contacts 201 contactable to the storing element contacts 100*b*.

Further, the constitution such that the moment, about the first positioning projection 87, acting on the cartridge B by the urging acting from the main assembly electrical contacts 201 to the storing element contacts 100*b* acts in the direction of urging the second positioning projection 88 toward the contact portion 12*a*1 is employed.

A constitution cartridge mounting system is summarized as follows. The cartridge mounting system is a mounting system for mounting the cartridge B which is detachably mountable to the apparatus main assembly A of the image forming apparatus 1 for forming the image on the recording material P and which contributes to the image forming process for forming the image on the recording material P. The apparatus main assembly A includes the receiving recessed portions 12*b*1, the contact portions 12*a*1 and the main assembly electrical contact 201.

The cartridge B includes, in the state in which the cartridge B is mounted at the image forming position of the apparatus main assembly A, the first positioning projections 87 held by the receiving recessed portions 12*b*1 and the second positioning projections 88 which are disposed at positions different from the positions of the first positioning projections 87 and which contact the contact portions 12*a*1. Further, the cartridge B includes the information storing member 100 having the storing element 100*a* for storing information and the storing element contacts 100*b* which are electrically connected with the storing element 100*a* and which are contactable to the main assembly electrical contacts 201.

Further, the constitution such that the moment, about the first positioning projection 87, acting on the cartridge B by the urging acting from the main assembly electrical contacts 201 to the storing element contacts 100*b* acts in the direction of urging the second positioning projection 88 toward the contact portion 12*a*1 is employed.

Other Embodiments (a) The cartridge B is not limited to the process cartridge of the integral type in which the image bearing member 62 for forming the latent image in Embodiments 1 and 2 and the developing means 32 for developing the latent image formed on the image bearing member 62 are provided.

The cartridge B may also be the process cartridge of the separation type in which the image bearing member 62 for forming the latent image and the image forming process means other than the developing means for developing the latent image formed on the image bearing member 62 are provided.

The cartridge B may also be the developing cartridge including the developing means 32 for developing the latent image formed on the image bearing member 62 for forming the latent image, and including the developer accommodating portion 29 for accommodating the developer used for developing the latent image.

The cartridge B may also include other units, such as the developer cartridge in which the developer is accommodated, which are detachably mountable to the apparatus main assembly A and which contributes to the image forming process for forming the image on the recording material.

(b) The image forming process of the image forming apparatus is not limited to the electrophotographic process, but may also be an electrostatic recording process using an electrostatic recording dielectric member as the image bearing member and a magnetic recording process using a magnetic recording (magnetic) material.

(c) The image forming apparatus is not limited to the image forming apparatus to which a single cartridge is detachably mountable, but may also be an image forming apparatus, for forming a color image, in which a plurality of cartridges different in color of developers accommodated therein are detachably mountable to predetermined mounting portions.

According to the present invention, the contact between the storing element contacts connected with the storing element for the cartridge and the main assembly electrical contacts provided in the apparatus main assembly can be stabilized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 139633/2013 filed Jul. 3, 2013, which is hereby incorporated by reference.

What is claimed is:

1. A cartridge detachably mountable to a main assembly of an image forming apparatus, including a receiving recessed portion, a contact portion and a main assembly electrical contact, for forming an image on a recording material, wherein said cartridge contributes to an image forming process for forming the image on the recording material, said cartridge comprising:

a first positioning projection to be held in the receiving recessed portion;

a second positioning projection, provided at a position different from a position of said first positioning projection, to be contacted to the contact portion; and an information storing member including a storing element for storing information and a storing element contact electrically connected with said storing element, wherein said storing element contact contacts the main assembly electrical contact, wherein a moment applied to said cartridge by a force applied from the main assembly electrical contact to said storing element contact acts in a direction of urging said second positioning projection to the contact portion.

2. A cartridge according to claim 1, wherein said storing element is provided downstream of said first positioning projection with respect to a mounting direction of said cartridge into the main assembly, and said second positioning projection is provided upstream of said first positioning projection with respect to the mounting direction.

3. A cartridge according to claim 1, wherein said storing element is provided upstream of said first positioning projection with respect to a mounting direction of said cartridge into the main assembly, and said second positioning projection is provided downstream of said first positioning projection with respect to the mounting direction.

4. A cartridge according to claim 1, which is a process cartridge of an integral type including a rotatable image bearing member for forming a latent image and image forming process means actable on said image bearing member.

5. A cartridge according to claim 4, wherein said image forming process means is at least a developing device unit including a developer carrying member for developing the latent image by supplying a developer to said image bearing member and a developer accommodating portion for accommodating the developer.

6. A cartridge according to claim 4, wherein said first positioning projection is provided substantially coaxially with a rotational axis of said image bearing member.

7. A cartridge according to claim 1, which is a process cartridge of a separation type in which a rotatable image bearing member for forming a latent image and image forming process means other than developing means for developing the latent image, formed on said image bearing member, with the developer.

8. A cartridge according to claim 1, which is a developing cartridge including a developer carrying member for developing a latent image by supplying a developer to a rotatable image bearing member on which the latent image is formed, and including a developer accommodating portion for accommodating the developer.

9. A cartridge according to claim 1, which is a developer cartridge in which a developer is accommodated.

10. An image forming apparatus for forming an image on a recording material, said image forming apparatus comprising:

a receiving recessed portion;

a contact portion;

a main assembly electrical contact; and a cartridge according to claim 1.

11. A cartridge according to claim 1, wherein said force applied from the main assembly electrical contact to said storing element contact is from a bottom of said cartridge to a top of said cartridge.

12. A cartridge according to claim 1, wherein said storing element contact is located below the main assembly electrical contact.

13. A cartridge according to claim 1, wherein said storing element contact is located at a lower side of said cartridge.

14. A main assembly of an image forming apparatus, for forming an image on a recording material, to which a cartridge including a first positioning projection, a second positioning projection provided at a position different from a position of the first positioning projection, and an information storing member which includes a storing element for storing information and a storing element contact electrically connected with the storing element is detachably mountable, said main assembly comprising:

in a state in which the cartridge is mounted at an image forming position of the image forming apparatus, a receiving recessed portion holding the first positioning projection;

a contact portion to which the second positioning projection is contacted; and a main assembly electrical contact contacting the storing element contact, wherein a moment applied to the cartridge by a force applied from the main assembly electrical contact to the storing element contact acts in a direction of urging the second positioning projection to the contact portion.

15. A main assembly according to claim 14, wherein said force applied from said main assembly electrical contact to said storing element contact is from a bottom of said cartridge to a top of said cartridge.

16. A main assembly according to claim 14, wherein said main assembly electrical contact is located above the storing element contact.

* * * * *